US006390593B1

(12) United States Patent
DeRoos et al.

(10) Patent No.: US 6,390,593 B1
(45) Date of Patent: May 21, 2002

(54) FOAM-FILLED CAPS FOR SEALING INKJET PRINTHEADS

(75) Inventors: Stephen M DeRoos, Camas, WA (US); Donald L Michael, Monmouth, OR (US); James E Green, Brush Prairie, WA (US); James A Harvey, Tangent, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/101,138

(22) PCT Filed: Oct. 29, 1997

(86) PCT No.: PCT/US97/19724

§ 371 Date: Mar. 6, 2000

§ 102(e) Date: Mar. 6, 2000

(87) PCT Pub. No.: WO98/18634

PCT Pub. Date: May 7, 1998

Related U.S. Application Data

(63) Continuation-in-part of application No. 08/808,366, filed on Feb. 28, 1997, now Pat. No. 5,956,053, which is a continuation-in-part of application No. 08/741,850, filed on Oct. 31, 1996, now Pat. No. 5,936,647.

(51) Int. Cl.[7] ..... B41J 2/165
(52) U.S. Cl. ..... 347/31; 347/29
(58) Field of Search ..... 347/29, 22, 24, 347/30–32

(56) References Cited

U.S. PATENT DOCUMENTS

| | | | | |
|---|---|---|---|---|
| 4,543,589 A | 9/1985 | Terasawa | | |
| 5,448,270 A | 9/1995 | Osborne | ..... | 347/29 |
| 5,712,668 A | 1/1998 | Osborne et al. | ..... | 347/32 |
| 6,084,608 A | 7/2000 | Harvey et al. | ..... | 347/33 |

FOREIGN PATENT DOCUMENTS

| | | | | |
|---|---|---|---|---|
| DE | 31107321 | 2/1981 | | |
| DE | 19531352 | 8/1995 | | |
| EP | 0375407 A2 | 6/1990 | ..... | B41J/2/165 |
| EP | 0540344 A2 | 5/1993 | ..... | B41J/2/165 |
| EP | 0552030 A1 | 7/1993 | ..... | B41J/2/165 |
| JP | 404014461 A * | 1/1992 | ..... | 347/29 |

OTHER PUBLICATIONS

Commonly–assigned, co–pending U.S. Patent Application Serial No. 08/710,597, filed Sep. 19, 1996, entitled "Wear Resistant Wiper for Ink Jet Print Head" Patented on Jul. 4, 2000, Pat. #6,084,608 Inv. Harvey et al.

* cited by examiner

*Primary Examiner*—N. Le
*Assistant Examiner*—Shih-Wen Hsieh
(74) *Attorney, Agent, or Firm*—Flory L. Martin

(57) ABSTRACT

A foam-filled cap sealing ink-ejecting nozzles of an inkjet printhead in a printing mechanism has a two-layer structure, with an outer skin layer of an elastomer, and a second foam core layer inside the skin. The skin defines a sealing lip that surrounds the nozzles when the cap is in a sealing position to avoid unnecessary drying of the ink. The skin has an interior surface that defines a cavity under the sealing lip. The foam core, located within the cavity, may be formed by expanding a foam preform or by injecting raw foam into the cavity. An insert may be molded into the cap structure for use in mounting the cap in the printing mechanism. An optional backing layer molded to the structure is used to attach a vent basin to the cap. A method of constructing this cap, and a printing mechanism having this cap, are also described.

53 Claims, 15 Drawing Sheets

FOAM-FILLED CAPS FOR SEALING INKJET PRINTHEADS

RELATED APPLICATION

This is a continuation-in-part application of the co-pending U.S. patent application Ser. No. 08/808,366, filed on Feb. 28, 1997 now U.S. Pat. No. 5,956,053, which is a continuation-in-part application of the co-pending U.S. patent application Ser. No. 08/741,850, filed on Oct. 31, 1996 now U.S. Pat. No. 5,936,647, all having at least one co-inventor in common.

FIELD OF THE INVENTION

The present invention relates generally to inkjet printing mechanisms, and more particularly to a foam-filled cap for sealing an inkjet printhead with an improved seal, particularly when sealing over surface irregularities on the printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, these service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper.

Early inkjet printers used a single monochromatic pen, typically carrying black ink. Later generations of inkjet printing mechanisms used a black pen which was interchangeable with a tri-color pen, typically one carrying the colors of cyan, magenta and yellow within a single cartridge. The tri-color pen printed a "process" or "composite" black image, by depositing drops of cyan, magenta, and yellow inks all at the same location. Unfortunately, the composite black images usually had rough edges, and a non-black hue or cast, depending for instance, upon the type of paper used. The next generation of printers further enhanced the images by using either a dual pen system or a quad pen system. The dual pen printers had a black pen and a tri-color pen mounted in a single carriage to print crisp, clear black text while providing full color images.

The quad pen printing mechanisms had four separate pens that carried black ink, cyan ink, magenta ink, and yellow ink. Quad pen plotters typically carried four pens in four separate carriages, so each pen needed individual servicing. Quad pen desktop printers were designed to carry four cartridges in a single carriage, so all four cartridges could be serviced by a single service station. As the inkjet industry investigates new printhead designs, there is a trend toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote location, typically inside a desktop printer, although large format plotters and industrial implementations may store their ink supplies external to the printing mechanism. The smaller on-board ink supply makes these off-axis desktop printers quite suitable for quad pen designs.

These earlier dual and quad pen printers required an elaborate capping mechanism to hermetically seal each of the printheads during periods of inactivity. A variety of different mechanisms have been used to move the servicing implements into engagement with respective printheads. For example, a dual printhead servicing mechanism which moves the caps in a perpendicular direction toward the orifice plates of the printheads is shown in U.S. Pat. No. 5,155,497, assigned to the present assignee, Hewlett-Packard Company, of Palo Alto, Calif. Another dual printhead servicing mechanism uses the carriage to pull the caps laterally up a ramp and into contact with the printheads, as shown in U.S. Pat. 5,440,331, also assigned to the Hewlett-Packard Company. A translational device for capping dual inkjet printheads is commercially available in the DeskJet® 720C model inkjet printer produced by the Hewlett-Packard Company. A rotary device for capping dual inkjet printheads is commercially available in several models of printers produced by the Hewlett-Packard Company, including the DeskJet® 850C, 855C, 820C, 870C and 890C model inkjet printers. Examples of a quad pen capping system that uses a translational motion are seen in several other commercially available printers produced by the Hewlett-Packard Company, including the DeskJet® 1200 and 1600 models. Thus, a variety of different mechanisms and angles of approach may be used to physically move the caps into engagement with the printheads.

The caps in these earlier service station mechanisms typically included an elastomeric sealing lip supported by a movable platform or sled. Typically, provisions were made for venting the sealing cavity as the cap lips are brought into contact with the printhead. Without a venting feature, air could be forced into the printhead nozzles during capping, which could deprime the nozzles. A variety of capillary passageway venting schemes are known to those skilled in the art, such as those shown in U.S. Pat. Nos. 5,027,134; 5,216,449; and 5,517,220, all assigned to the present assignee, the Hewlett-Packard Company.

The earlier cap sleds were often produced using high temperature thermoplastic materials or thermoset plastic materials which allowed the elastomeric sealing lips to be onsert molded onto the sled. The elastomeric sealing lips were sometimes joined at their base to form a cup-like structure, whereas other cap lip designs projected upwardly from the sled, with the sled itself forming the bottom portion of the sealing cavity. Unfortunately, the systems which used a portion of the sled to define the sealing cavity often had leaks where the cap lips joined the sled. To seal these leaks at the lip/sled interface, higher capping forces were used to physically push the elastomeric lip into a tight seal with the sled. This solution was unfortunate because these higher capping forces may damage, unseat or misalign the printhead, or at the vary least require a more robust printhead design which is usually more costly.

Capping systems need to provide an adequate seal while accommodating a several different types of variations in the printhead. For example, today's printhead orifice plates often have a waviness or ripple to their surface contour because commercially available orifice plates unfortunately are not perfectly planar. Besides waviness, these orifice plates may also be slightly bowed in a convex, concave or compound (both convex and concave) configuration. The waviness property may generate a height variation of up to 0.05–0.08 millimeters (2–3 mils; 0.002–0.003 inches). These orifice plates may also have some inherent surface roughness over which the cap must seal. The typical way of coping with both the waviness problem and the surface roughness problem is through elastomer compliance, where a soft material is used for the cap lips. The soft cap lips compress and conform to seal over these irregularities in the orifice plate. For instance, one earlier suspended lip configuration having a single upwardly projecting ridge for a sealing lip is shown in U.S. Pat. No. 5,448,270, assigned to the Hewlett-Packard Company, the present assignee.

Another major surface irregularity over which some printhead caps must seal are one or more encapsulant beads which are used to attach the silicon nozzle plate to a portion of an electrical flex circuit which delivers firing signals to energize the printhead resistors. An energized resistor heats the ink until a droplet is ejected from the nozzle associated with the energized resistor. These encapsulant beads project beyond the outer surface of the nozzle plates. In the past, caps were designed to avoid sealing over the encapsulant bead regions, either by sealing between the beads or beyond them. One printer design, the DeskJet® 693C color inkjet printer sold by the Hewlett-Packard Company of Palo Alto, Calif., has a capping system that accommodates interchangeable black and photo-quality color pens, either of which is used in combination with a standard tri-color pen. This capping system used a multiple sealing lip system to seal across (perpendicular to) the encapsulant beads.

One other earlier capping system, is currently commercially available in the DeskJet® 850C, 855C, 820C and 870C model color inkjet printers, sold by the Hewlett-Packard Company of Palo Alto, Calif. The capping system in these earlier printers used a multiple sealing lip system to seal along the length of the encapsulant beads. That is, in this earlier design the multiple sealing lips ran parallel to the encapsulant beads to accommodate for manufacturing tolerance accumulation and/or cap placement tolerance, so at least one of the multiple lips would land in a suitable location on the orifice plate to form a seal. Unfortunately, these fine multiple lips are very difficult to manufacture, Often the lips break off as they are removed from the mold, so the scrap rate is relatively high, which translates to a higher overall piece price for the printer manufacture. Indeed, only a few companies are even capable of consistently producing quality caps of this multi-lip design.

Proper capping requires providing an adequate hermetic seal without applying excessive force which may damage the delicate printheads or unseat the pens from their locating datums in the carriage. Moreover, it would be desirable to provide such a capping system which is more economical to manufacture than earlier capping systems, and which can be manufactured by a variety of vendors.

SUMMARY OF THE INVENTION

According to one aspect of the present invention, a cap is provided for sealing ink-ejecting nozzles of an inkjet printhead in an inkjet printing mechanism. The cap includes a skin layer of an elastomer having an exterior surface and a interior surface, with the exterior surface defining a sealing lip to surround the ink-ejecting nozzles when said cap is in a sealing position and to define a sealing chamber. The interior surface of the skin layer defines a cavity under at least a portion of the sealing lip. The cap also includes a foam core within the cavity.

According to another aspect of the present invention, a method is provided of constructing a printhead cap for sealing ink-ejecting nozzles of an inkjet printhead in an inkjet printing mechanism. The method includes the steps of molding a skin layer of an elastomer having an exterior surface and an interior surface, with the exterior surface defining a sealing lip to surround the ink-ejecting nozzles when said cap is in a sealing position and to define a sealing chamber, with the interior surface of the skin layer defining a cavity opposite at least a portion of the sealing lip. In a foaming step, an elastomer is foamed within the cavity to form a foam core in the cavity. According to another aspect of the present invention, an inkjet printing mechanism may be provided with a capping system as described above.

An overall goal of the present invention is to provide an inkjet printing mechanism which prints sharp vivid images over the life of the pen and the printing mechanism, particularly when using fast drying pigment or dye-based inks.

A further goal of the present invention is to provide a capping system that adequately seals inkjet printheads in an inkjet printing mechanism, with the capping system being easier to manufacture than earlier systems to provide consumers with a robust, reliable and economical inkjet printing unit.

DETAILED DESCRIPTION OF A PREFERRED EMBODIMENT

Figure 1:
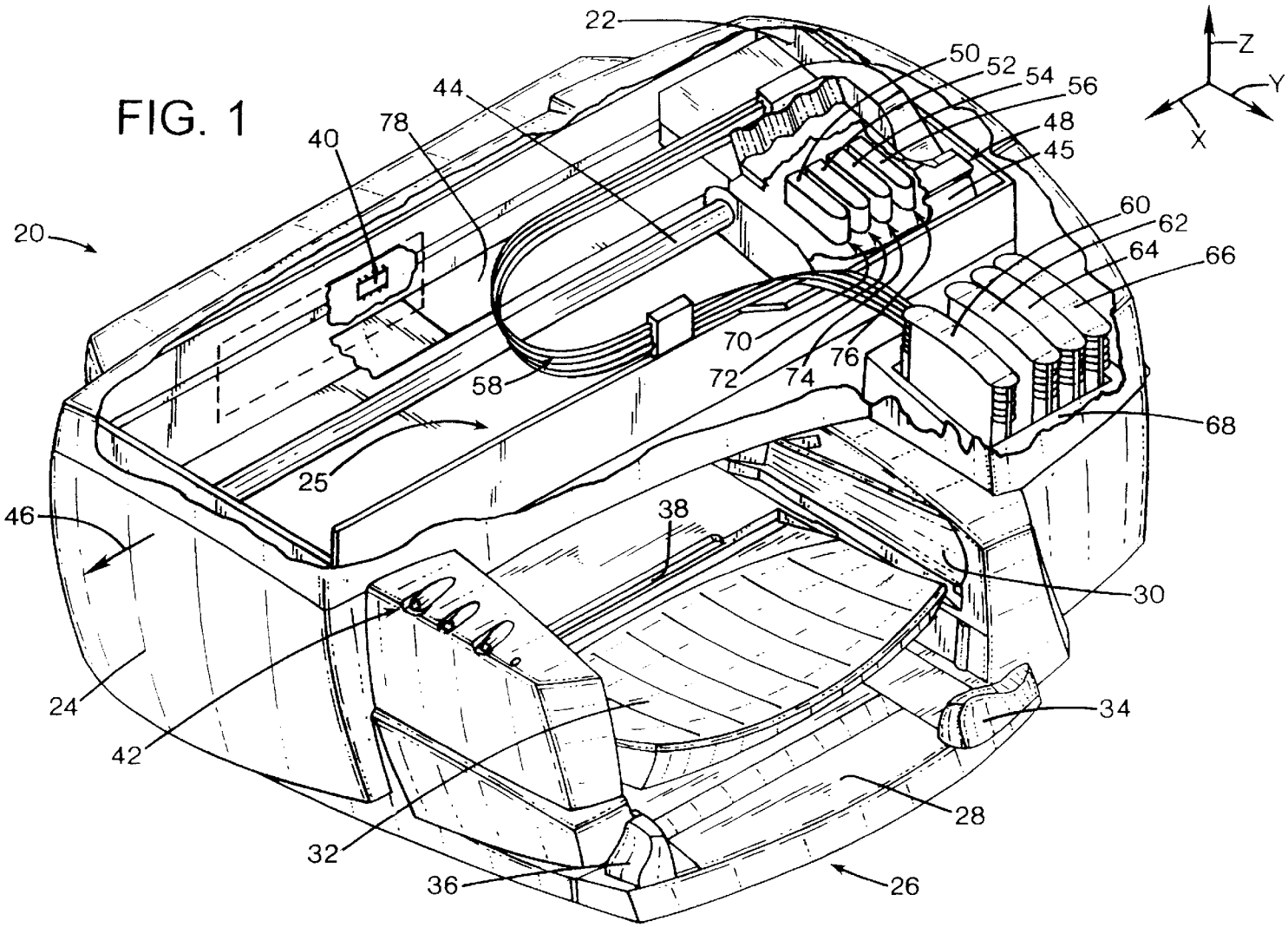
FIG. 1 is a perspective view of one form of an inkjet printing mechanism, here, an off-axis inkjet printer, including a printhead service station having a capping system of the present invention.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, fan-folded banner paper, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown) or a local area network ("LAN") system. The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
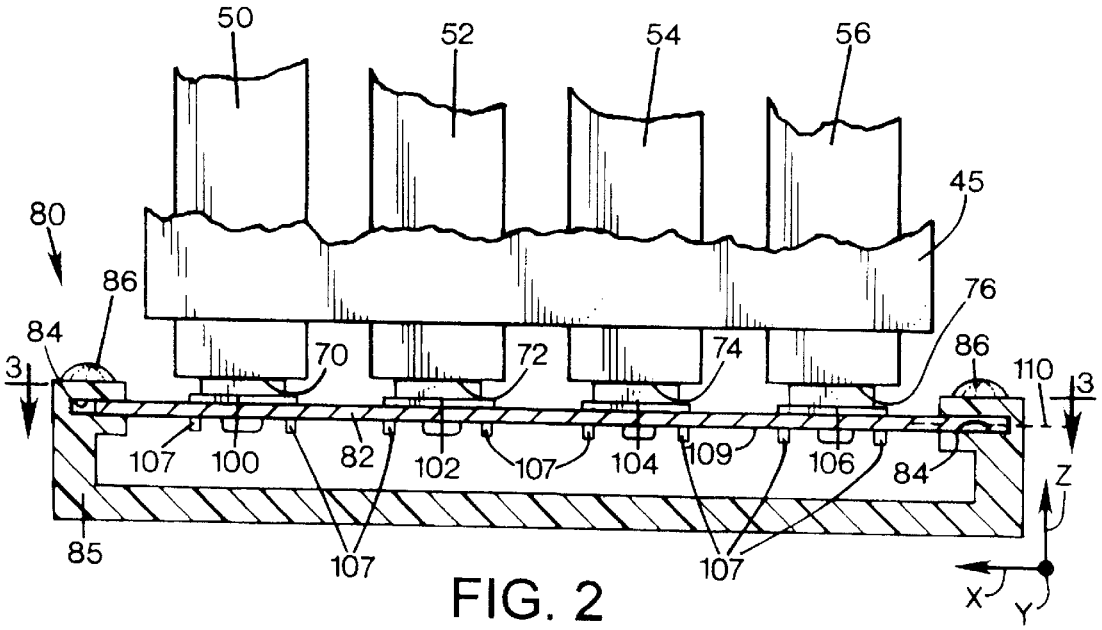
FIG. 2 is an enlarged front elevational sectional view of one form of a capping system of the present invention, shown supported by a sled and sealing four discrete inkjet printheads mounted in a single carriage.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

High Deflection

Capping System

Figure 3:
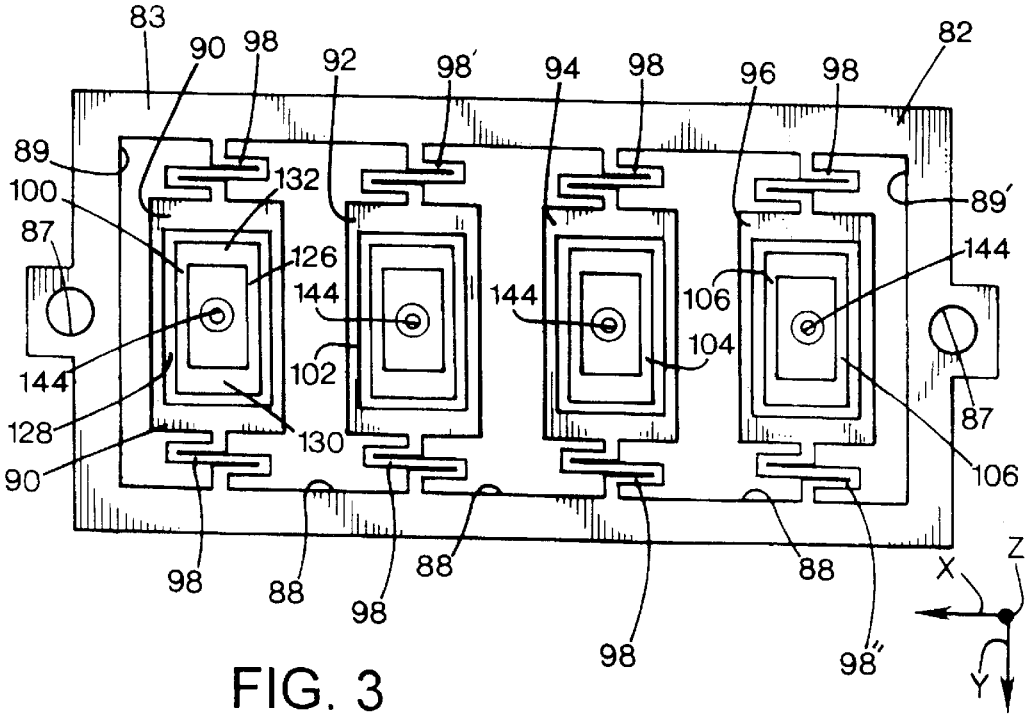
FIG. 3 is a top plan view taken along line 3—3 of FIG. 2, with the sled omitted for clarity.

FIGS. 2 and 3 illustrate one form of a high deflection capping system 80 constructed in accordance with the present invention for sealing the printheads 70–76 of pens 50–56. In the illustrated embodiment, the capping system 80 includes a flexible frame 82 that has an outer border portion 83 which is received within a pair of slots 84 of a capping sled portion 85. To secure the frame 82 to the sled 85, two fasteners, such as rivets or self-tapping screws 86, are inserted into a pair of holes (not shown) in sled 85, with the fasteners also engaging a pair of holes 87 defined by the frame border 83. While a screw and slot arrangement is shown to attach the frame 82 to sled 85, it is apparent that a variety of other attachment means may be used to secure the frame 82 to the sled. For example, rather than sliding the frame 82 into slots 84, each slot 84 may be closed at each end, and the frame 82 flexed for insertion into the slots 84.

The flexible frame 82 may be constructed of any type of plastic or metallic material having a spring characteristic that allows the frame to return to its natural, preferably flat, state after being stressed or bent into a position away from that natural state. The preferred material for the frame 82 is a stainless steel, such as ASTM 301 or 304 stainless steel, preferably full-hard and cold-rolled which provides a substantially constant spring-rate over the life of the frame 82, or a precipitation hardening steel alloy like type 17-7 typically used to make springs and structural components. For instance, a frame 82 constructed of a metallic shim stock material, on the order of 0.508 millimeters (nominally 0.020 inches) thick, was found to perform suitably. A stainless steel is preferred because it has superior durability and resistance to corrosion, not only from the ink but also from other environmental factors, such as high humidity or rapid changes in temperature during transport. In addition to the 300-series stainless steel alloys, it is also believed that other alloys would be suitable, for example the 400-series of stainless alloys.

Conventional spring steels may also be suitable for frame 82, although they may need some surface preparation, such as a paint or other coating to protect them from corrosion due to environmental factors or from degradation caused by the ink itself. While various plastic materials were not tested, it is believed that plastics may also serve as suitable materials for the flexible frame 82. However, given the performance characteristics of the current commercially available plastics, metals are preferred because these plastics have a tendency to creep when stressed. "Creep" is a term used in the plastics industry to describe the failure of a plastic to return to its original shape after being stressed without losing any restoring force or spring rate. The metals proposed herein for frame 82 do not suffer creep failure. Moreover, preferably onsert molding techniques are used to manufacture capping assembly 80, and the use of a metal frame 82 allows for higher onsert molding temperatures. Such higher onsert molding temperatures are believed to promote better bonding of elastomers to the frame 82, as well as more complete curing or cross-linking of the elastomeric material. Higher molding temperatures also yield faster curing times, which in turn provides a shorter manufacturing cycle, with a resulting lower cost to manufacture the cap assembly 80. Indeed, if the cap sled 85 is of a plastic material, the frame 82 may be insert molded as an integral portion of the sled 85.

As described in the Background section above, the cap sled 85 may be moved into engagement with the printheads 72–76 in a variety of different manners known to those skilled in the art. For instance, the cap sled 85 may approach the printheads 70–76 translationally, rotationally, diagonally or though any combination of these motions, depending upon the type of sled movement mechanism employed. Several different movement mechanisms and sled arrangements are shown in U.S. Pat. Nos. 4,853,717; 5,103,244; 5,115,250; 5,155,497; 5,394,178; 5,440,331; and 5,455,609, all assigned to the present assignee, the Hewlett-Packard Company. Indeed, in other pen support mechanisms, it may be more practical to move the printheads 70–76 into contact with the capping system 80, or to move both the printheads and the capping system 80 together into a printhead sealing position.

As best shown in FIG. 3, inside the border 83 a series of intricately fashioned holes or recesses 88, 89 and 89' have been cut through frame 82 to define four cap bases 90, 92, 94 and 96 which lie under the respective printheads 70, 72, 74 and 76 during capping. At each end of the cap bases 90–96, the base is attached to the border 83 by a suspension spring element, such as an S-shaped spring member 98 defined by the holes 80, 89 and 89' formed through the frame 82. The holes 80, 89 and 89' may be formed by removing material from the frame 82, for example through laser removal techniques, etching, punching or stamping, or other methods known to those skilled in the art. The spring elements 98 may take a variety of different forms, and the configurations for springs 98 shown herein are by way of illustration only to describe the concepts of the flexible frame support system. Thus, it is apparent that other spring configurations may also be used to implement these concepts.

Preferably four elastomeric sealing lips 100, 102, 104 and 106 are onsert molded onto each of the cap bases 90, 92, 94 and 96, respectively. The manner of onsert molding the cap lips 100–106 onto the bases 90–96 may be done in a variety of different manners known to those skilled in the art for bonding elastomeric materials to metals or plastics. For example, the flexible frame, here frame 82, may define a series of holes through the frame under the sealing lips 100–106 to allow the elastomer to flow through these holes, forming an anchoring pad or stitch point 107 of the elastomer along an underside 109 of the frame 82, with these stitch points 107 being shown in FIG. 2.

The material selected for the cap lips 100–106 may be any type of resilient, non-abrasive, elastomeric material, such as nitrile rubber, elastomeric silicone, ethylene polypropylene diene monomer (EPDM), or other comparable materials known in the art, but EPDM is preferred for its economical cost and durable sealing characteristics which endure through a printer's lifetime. One preferred compound for the caps 100–106 of FIGS. 2 and 3 comprises a flexible elastomeric matrix containing particles of a material harder than the matrix which allow the particles to resist wear and prolong the useful life of the caps. These particles may be of a nonabrasive, hard polymer, such as polyethylene. Preferably, the particles are bonded to the elastomeric matrix with a coupling agent, such as silane. A preferred softness for the caps 100–106 in FIGS. 2 and 3 is in the durometer range of 25–45, with a more preferred value being a durometer of 35±5, as measured on the Shore A durometer scale.

Now that the basic components of the capping system 80 have been described, the basic manner of operation and method of sealing printheads 70–76 will be discussed. To aid in explaining this operation, a Cartesian coordinate axis system, having positive XYZ coordinate axes oriented as shown in FIG. 1, will be used. Here, the positive X-axis extends to the left from the service station area 48 across the printzone 25, parallel with the scanning axis 46. The positive Y-axis is pointing outwardly from the front of the printer 20, in the direction which page 34 moves onto the output wings 36 upon completion of printing. The positive Z-axis extends upwardly from the surface upon which the printer 20 rests. This coordinate axis system is also shown in several of the other views to aid in this discussion.

While a variety of different embodiments of the spring elements are shown herein, such as springs 98, preferably each type of suspension spring accomplishes the function of having both cantilever characteristics and torsional characteristics. These cantilever and torsional characteristics of the suspension springs allow the cap bases 90–96 to flex and rotate at least a fraction of the base out of a reference plane 110, which is defined by an unflexed state of the frame border 83. This flexibility of the cap base 90 to pivot and tilt with respect to the reference plane 110 allows the bases to function as independent spring-suspended platforms, similar to the ability of a trampoline to flex with respect to its frame. The trampoline analogy breaks down somewhat because a trampoline platform stretches, whereas the illustrated bases 90–96 are substantially rigid to provide firm support for the cap lips 100–106. It is apparent that the bases 90–96 may be locally reinforced for increased stiffness without impacting the springs 98. For instance, the bases 90–96 may be stiffened by adding ribs or dimples through molding for a plastic frame, or through a stamping process for a metallic frame, or by onsert molding other stiffening materials to the base, such as a rigid plastic member.

As described further below, the upper surface of each of the caps 100–106 form sealing lips which provide a substantially hermetic seal when engaged against the respective printheads 70–76 to define a sealing chamber or cavity between each orifice plate, lip and cap base, which retards drying of the ink within the nozzles. The cap lips 100–106 may be sized to surround the printhead nozzles and form a seal against the orifice plate, although in some embodiments it may be preferable to seal a larger portion of the printhead, which may be easily done by varying the size of the sealing lips to cover a larger area of the printheads 70–76. The configuration of the preferred sealing edge of cap lips which actually contact the printheads 70–76 is described further below with respect to FIGS. 4–5 and 7.

Figure 4:
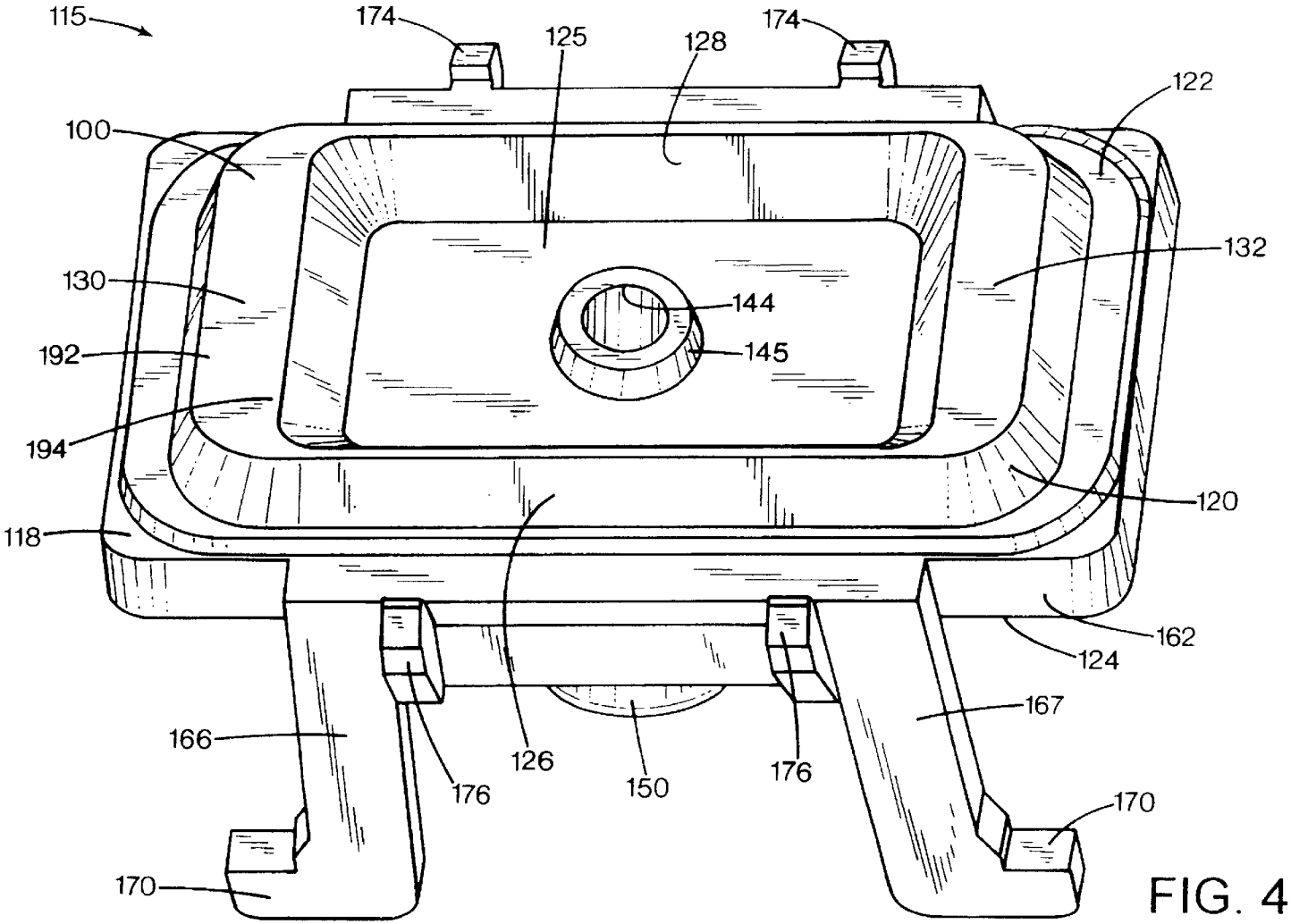
FIG. 4 is an enlarged perspective view of an alternate manner of constructing the capping system resent invention.
Figure 5:
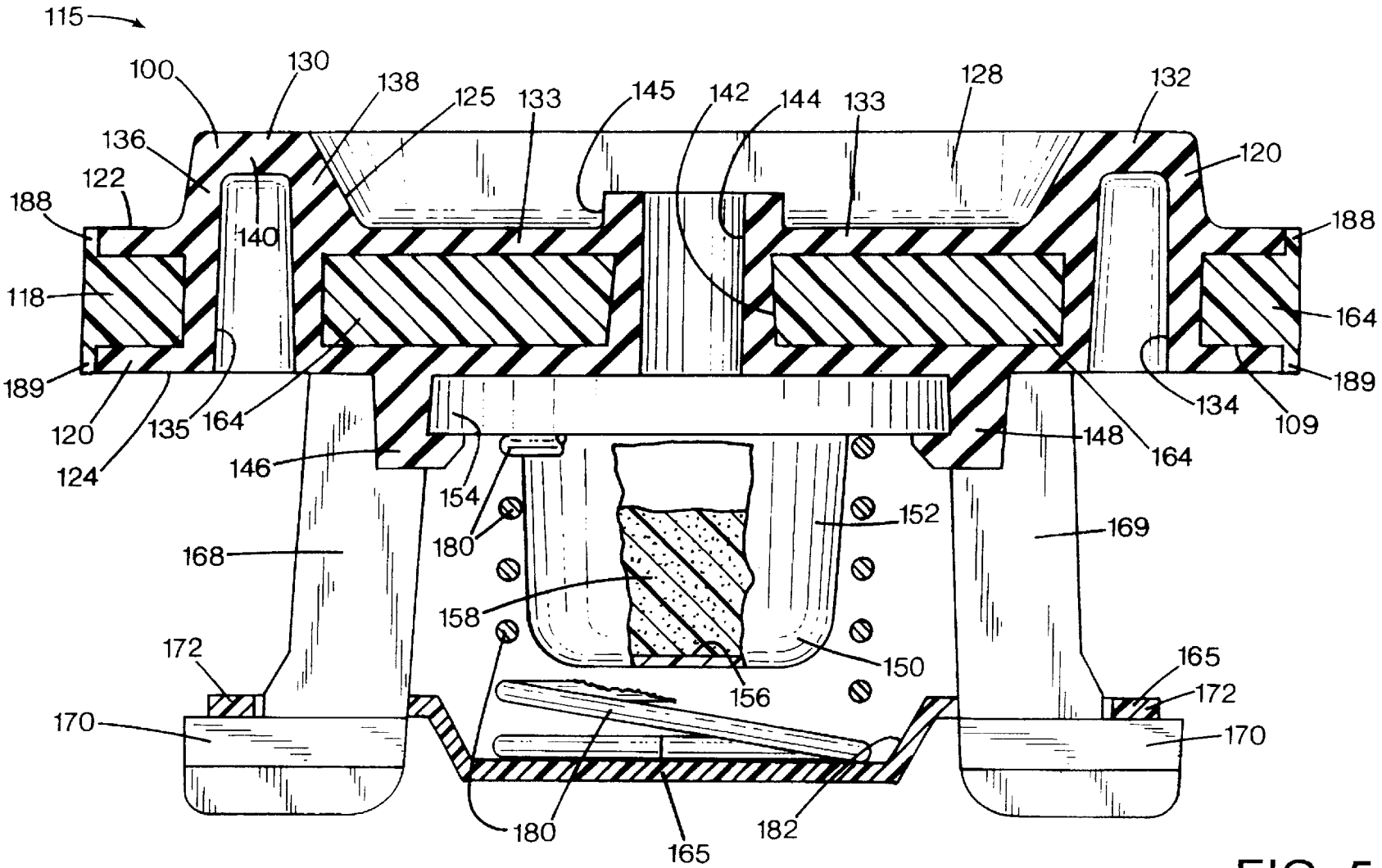
FIG. 5 is an enlarged, side elevational, sectional view of the capping system of FIG. 4.

FIGS. 4 and 5 show an alternate high deflection capping system 115 constructed in accordance with the present invention using the elastomeric cap body 100 of FIGS. 2–3, in combination with an alternate support frame or base 118, here molded of a plastic material suitable for withstanding onsert molding temperatures and pressures, which may be substituted for the metallic cap base 90. The cap 100 has an elastomeric body 120 which may be onsert molded to the metallic cap base 90 or plastic base 118. The body has an upper surface 122 projecting upwardly to seal the printhead 70, and a lower surface 124 extending downwardly from the lower surface 109 of base 118. The upper surface 122 is contoured to form a generally rectangular shaped sealing chamber 125, defined by an opposing pair of longitudinal lips 126, 128, and an opposing pair of high deflection lateral sealing lips 130, 132. The cap body 120 also has a bottom wall 133 which extends between lips 126–132 along the upper surface of the cap base 90 to line sealing chamber 125 with elastomer, which advantageously avoid leaks encountered in the earlier printers at the lip/sled interface. Projecting inwardly from the body lower surface 124 directly under lips 132, 130 are two deflection cavities 134, 135, respectively. While it is apparent that the shapes of the lips 130 and 132 may be varied, in the illustrated embodiment, these high deflection lips 130, 132 are symmetrical, so a discussion of the operation of lip 130 will suffice to explain the operation of lip 132. Here, the deflection cavity 135 serves to define opposing exterior and interior walls 136, 138 of lip 130, with the walls 136, 138 being bridged by a sealing wall 140. The outer surface of the interior wall 138 assists in defining the sealing chamber 125. Before discussing the operation of the high deflection sealing lips 130, 132 with respect to FIG. 7, the remainder of the components of cap 100 will be described.

As mentioned in the Background section above, there are a variety of different methods for venting the sealing chamber when contacting the printheads 70–76 with lips 100–106 to relieve pressure and prevent pushing air into the orifices, which otherwise could deprime the pens. In the illustrated embodiment, each of the cap bases 90–96, 118 has a vent aperture, such as hole 142, extending from the sealing chamber to a lower surface 109 of the frame 82, 118. During the onsert molding process, a vent throat 144 of elastomer lines the hole 142 and extends from the body upper surface 122 through to the lower surface 124. Adequate venting may be provided by adjusting the size of the effective diameter of the vent throat 144.

Preferably, the vent throat 144 extends upwardly above the bottom wall 133 of the sealing cavity 125 to define an entry neck portion 145. The neck 145 advantageously prevents minor ink leakage from the printhead 70, such as during an accidental drool event, from immediately draining into the vent throat 144. Moisture can also accumulate in the cap chamber 125 as moisture trapped in the air inside the sealing chamber begins to condense. The exterior upper periphery of the neck 145 is preferably formed with a relatively sharp comer (when viewed in cross section in FIG. 5) approximating 90° (neglecting draft deviations required for the molding process). This sharp periphery of neck 145, in combination with the meniscus forces operating along the upper surface of an ink pool, serves to hold back a substantial amount of ink from falling into the vent throat 144.

The lower surface 124 of the cap body 120 preferably is formed with at least two basin gripping ridges 146, 148 which resiliently grip a catch basin 150. The catch basin 150 has a bowl portion 152 and a rim portion 154 extending outwardly from the upper edge of the bowl 152. Opposing sides of the rim 154 are grasped by the gripping ridges 146, 148 to hold the basin tightly against the lower surface 124 of the cap body 120, with the bowl 152 positioned to collect any ink escaping from the sealing cavity 125 through the vent throat 144.

While an interior portion 156 of the bowl 152 may be left empty, in the illustrated embodiment, the bowl 152 is filled with an absorbent pad 158 which may be of any type of liquid absorbent material, such as of a felt, pressboard, sponge or other material, here shown as a sponge pad 158. The sponge pad 158 may be shipped from the factory in a dry state, but more preferably, the sponge 158 is soaked with a hygroscopic material, such as PEG (polyethylene glycols), LEG (lipponic-ethylene glycols), DEG (diethylene glycols) or glycerine. These hygroscopic materials are liquid or gelatinous compounds that can absorb up to their own weight in water. After sealing the printhead 70, any previously absorbed water is released from the hygroscopic material reducing the rate of evaporation required from the nozzles to humidify the sealing chamber 125 up to near a 100% relative humidity state that assists in preventing the ink inside the printhead nozzles from drying. Eventually this saturated condition within the sealed cap tapers off to ambient relative humidity, through a vent passageway, described further below with respect to FIGS. 9 and 10. In addition, the use of a hygroscopic material in conjunction with pad 158 displaces and reduces the volume of air that must reach the saturation point within the sealed cap. The reduced cap volume more quickly reaches equilibrium with the diffusion rate of the vent path, leaving the nozzles in a preferred start-up state, particularly after a short period of time in a capped state. Moreover, when using pad 158, the foam aids in handling ink leakages, such as from accidental pen drool events.

Figure 6:
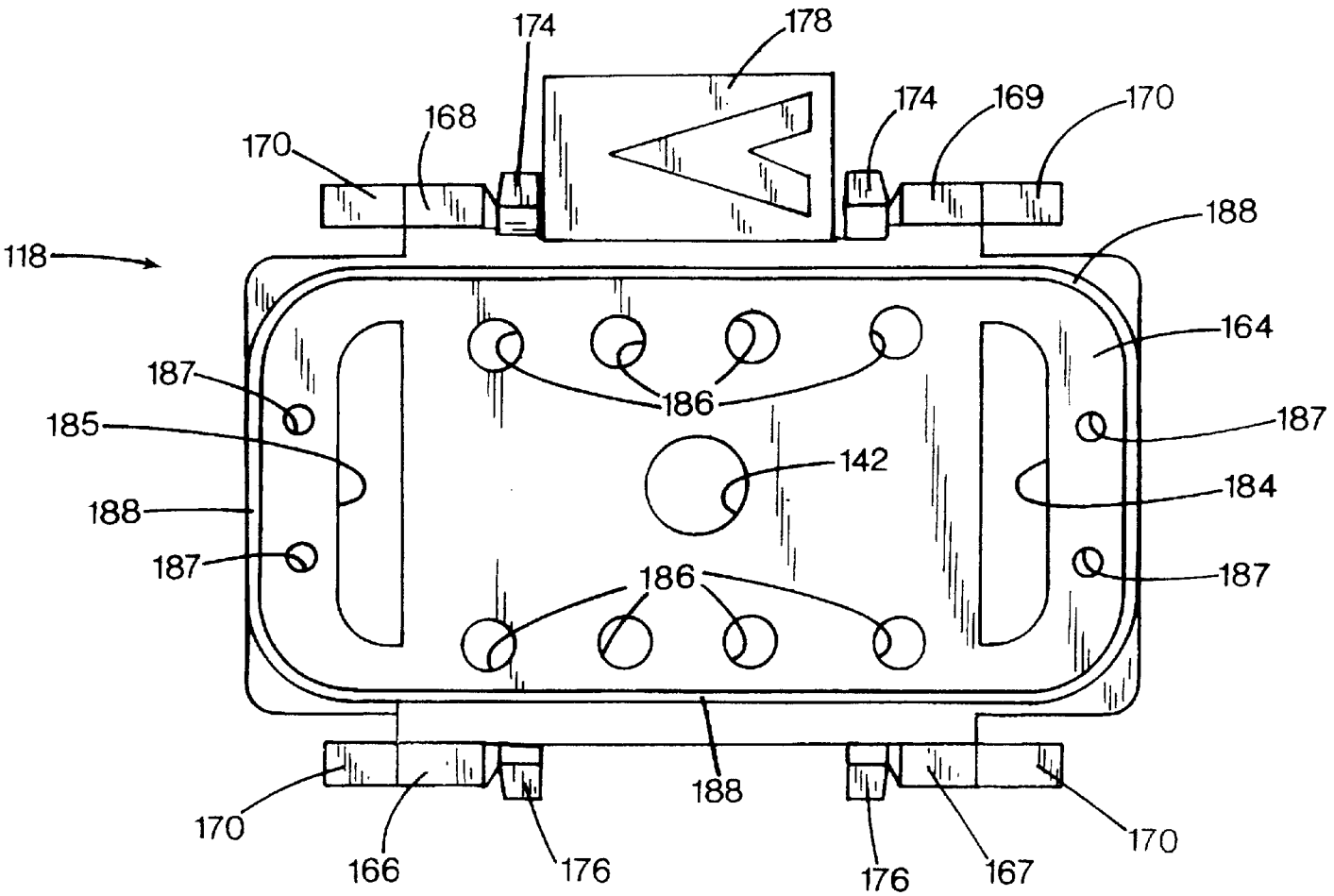
FIG. 6 is a top plan view of the support member upon which the cap of FIG. 4 is onsert molded.

Turning to FIGS. 4–6, the plastic frame base 118 includes a base table portion 164 which joins the cap assembly to a service station sled 165. To couple cap assembly 100 to the sled 165, the base 118 has four legs 166, 167, 168 and 169 projecting downwardly from the table 164, with each leg 166–169 terminating in a foot portion 170, as also shown in FIG. 6. Each of the feet 170 is captured by a location arm 172 portion of the sled 165, with the arms 172 in the illustrated embodiment extending outwardly from a position underneath table 164. As shown in FIGS. 4 and 6, first and second pairs of location datums 174 and 176 may extend from table 164 to engage a pen alignment member 178, one of which is shown schematically in FIG. 6, or to engage datums 176 and 174 on an adjacent base that supports another cap.

As shown in FIG. 5, a biasing member, such as a compression coil spring 180, is used to urge the cap assembly away from the service station sled 165 and into engagement with the printhead. The sled 165 defines a recessed pocket 182, located centrally under the cap assembly 100, that receives the lower portion of spring 180. The upper end of spring 180 wraps around the catch basin bowl 152, and pushes against the lower surface of the basin rim 154. The feet 170 of each of the frame legs 166–169 are pulled upwardly under the force of spring 180 into engagement with the lower surface of the sled location arms 172 when uncapped. When capped, the capping force slightly compresses the spring 180, allowing the legs 166–169 to move downwardly away from the service station sled 165.

Figure 7:
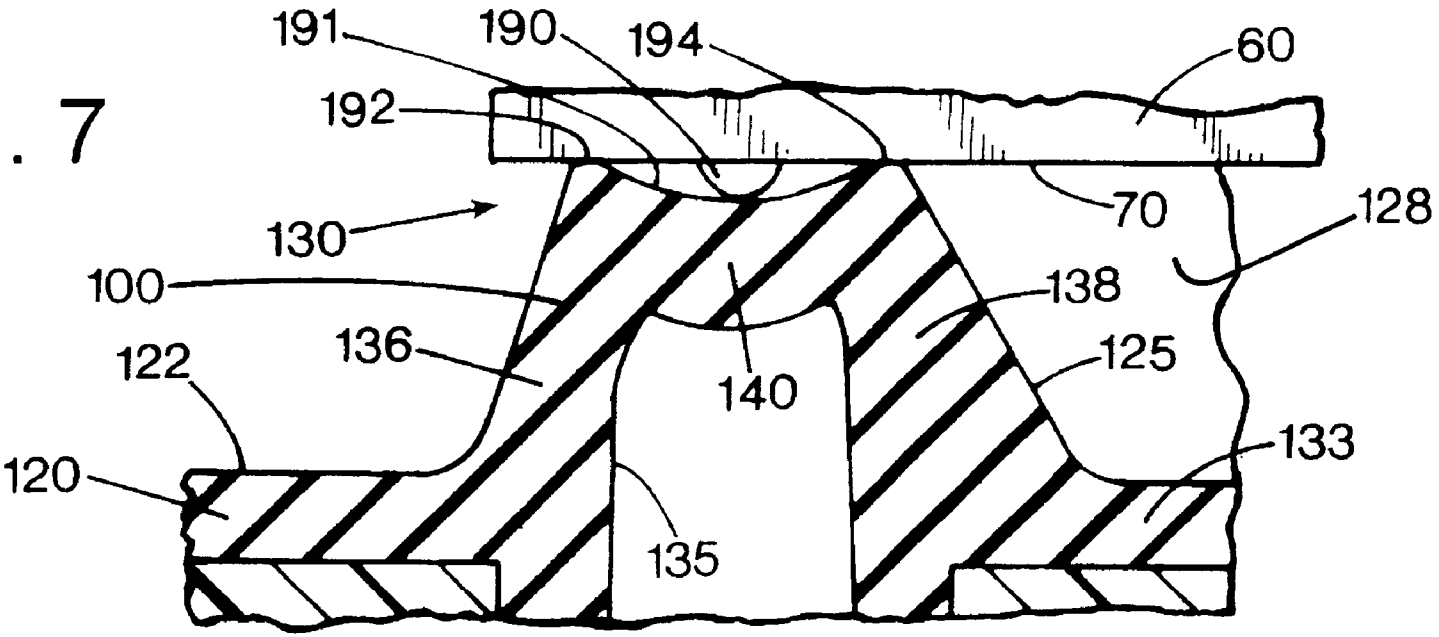
FIG. 7 is enlarged, side elevational, sectional view of the sealing lip portion of the capping system FIG. 4 shown sealing over an encapsulant bead of a printhead.

Before leaving the description of the cap base 118, several other features that assist in facilitating the onsert molding process are noted with respect to FIG. 7, which shows the illustrated embodiment of the cap base 118 before the onsert molding process has formed the cap body 120. To form the deflection cavities 134 and 135, the table 164 defines two slots 184, 185 extending therethrough. To help secure the upper and lower portions of the cap body 120 to the base 164, a first group of onsert mold plug holes 186 extend through the table 164 between the deflection cavity slots 184, 185. Between the slots 184, 185 and adjacent outboard edges of table 164, a second group of onsert mold plug holes 187 extend through table 164. The elastomeric material of body 120 flows through holes 186 and 187 during the onsert molding process. Finally, to contain the elastomeric material of body 120 at the periphery of the base 164, upper and lower barriers or fences 188 and 189 project outwardly from the respective upper and lower surfaces of the base, as shown in FIGS. 5 and 6.

FIG. 7 shows the black cap 100 the sealing the printhead 70 over an encapsulant bead 190 of the black ink printhead 70. To seal the printhead, the high deflection lip 130 comprises a sealing region that has a central portion 191 which deflects downwardly into the hollow deflection cavity 135 to form a smiling shape when viewed in cross section as shown in FIG. 7. The two extreme edges of this smile-shaped deflection form a dual seal comprising two sealing bands 192 and 194 along the exterior and interior edges of lip 130, bordering the central portion 191. In the process of forming this smiling shape, the exterior and interior walls 136, 138 may flex or bow slightly inward or outward as the wall 140 flexes down and buckles the walls 136, 138. Indeed, the upright support provided by walls 136 and 138 assists in defining the sealing bands 192, 194. The seals 192, 194 join each other at the ends near where lips 130 and 132 join the longitudinal lips 126 and 128. Thus, the two opposing bands 192, 194 substantially form a seal against the printhead in the sealing regions 130, 132 of the cap lip.

This dual seal 192, 194 may be viewed by pressing the cap 100 against a clear surface, such as a glass window pane. The dual seal feature advantageously accommodates sealing over other surface irregularities, such as ink residue, lint or other debris, which may inadvertently cling to the orifice plate 70–76. For example, an errant lint fiber trapped under the exterior seal 192 would have no adverse effect on the performance of the interior seal 194. Thus, the humid environment inside the sealing cavity 125 when capping is maintained by seal 194, despite the presence of any leakage caused by the lint fiber under seal 192. Indeed, the encapsulant bead 190 in FIG. 7 presents no difficulty for the lip 130, which just flexes a little more than when sealing against a flat portion of the orifice plate of the printheads.

Figure 8:
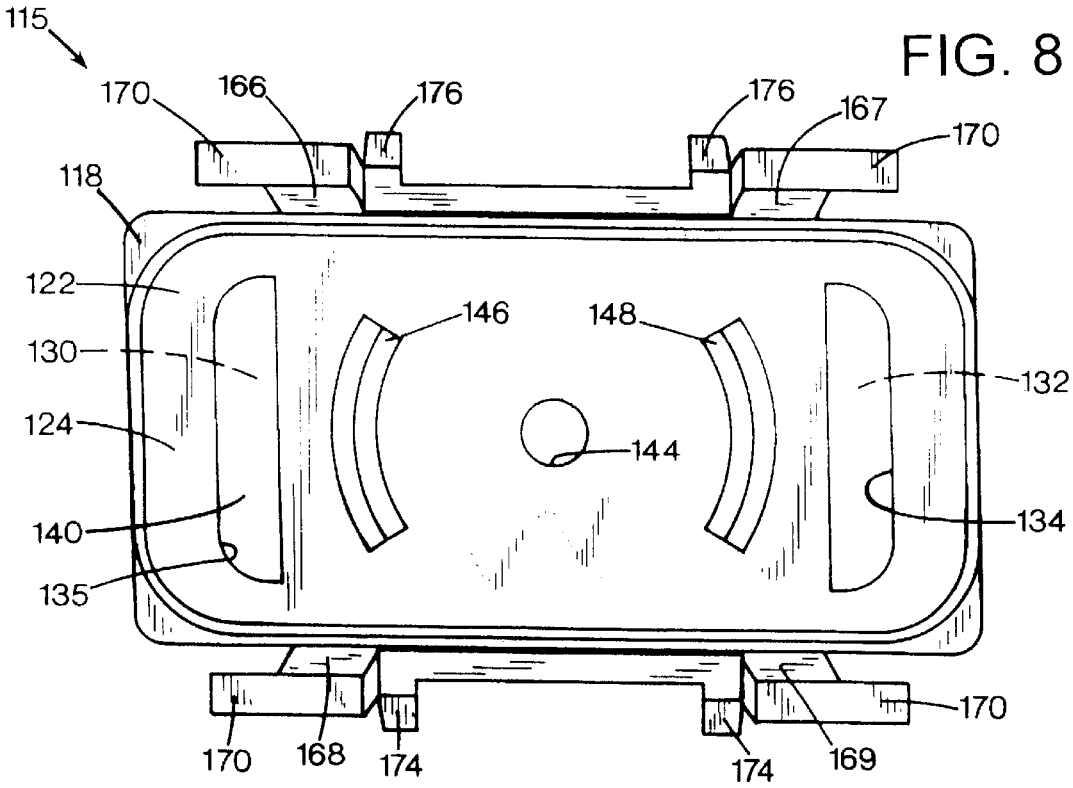
FIG. 8 is a bottom view of the capping system of FIG. 4, shown with the catch basin removed.
Figure 9:
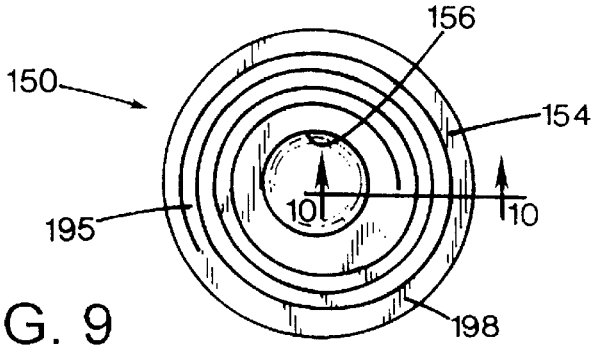
FIG. 9 is a top plan view of the catch basin portion of the capping system of FIG.4.
Figure 10:
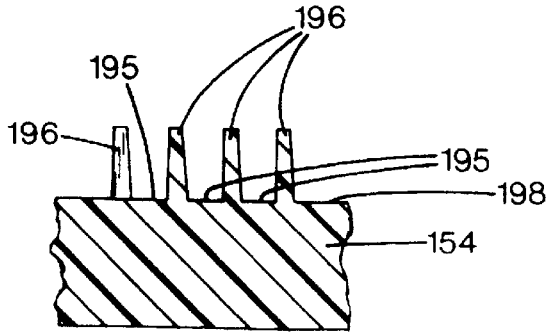
FIG. 10 is an enlarged, side elevational, sectional view taken along line 10—10 of FIG. 9.

FIG. 8 shows the bottom surface 124 of the cap body 120 with the catch basin 150 removed to better illustrate the shape of one embodiment of the basin gripping ridges 146, 148. To prevent the cap 100 from forcing air into the printhead nozzles, the vent throat 144 joins the sealing cavity 125 to the basin interior 156. As shown in FIGS. 9 and 10, the upper surface of rim 154 has a trough, here shown as a spiral groove formed therein to define a vent passageway 195 when assembled against the body lower surface 124. In the illustrated embodiment, the spiral vent path 195 is defined by a spiral ridge 196 that extends upwardly from an upper surface 198 of the basin rim 154. The vent passageway 195 extends from an entrance port at the chamber basin chamber 156 to an exit port at ambient atmosphere to provide the last portion of the vent path from the sealing chamber 125 to atmosphere. Preferably, the vent tunnel 195 has a long and narrow configuration, with a small cross sectional area to prevent undue evaporation when the printhead is sealed, while also providing an air vent passageway during the initial sealing process. By varying the length of the spiral vent path 195, a desired rate of venting may be easily achieved.

Foam-Filled
Capping System

FIGS. 11–19 show an alternate form of a foam-filled capping system constructed in accordance with the present invention as including one or more two-layer, foam-filled caps 200, which may be substituted for caps 100–106 of the high deflection capping systems 80, 115 illustrated above with respect to FIGS. 2–10. As described in the Background section above, sealing four closely spaced printheads, such as those of pens 50–56 in printer 20, has proved quite challenging, because the caps must not only adequately seal each printhead 70–76, but the caps must also accommodate manufacturing tolerances accumulated between pens 50–56, and the carriage 45, as well as the tolerances contributed by the service station itself. These manufacturing tolerances or "stack" refers to assuming the two worst case scenarios where one unit is built with all parts having the minimum allowable dimensions, and another unit is built with all parts having the maximum allowable dimensions, with the caps being required to seal each of these worst case extremes, where an adequate seal must be maintained on the "minimum dimension" unit, and excess capping forces must be avoided on the "maximum dimension" unit.

The first capping solution used the torsional, flexible frame 82 as illustrated with respect to FIGS. 2 and 3. An alternate proposed system used the cap base 118, an unfilled basin 150, and spring 180, along with a solid elastomer cap, differing from the high deflection cap 120 by not having deflection cavities 134, 135. The high deflection capping assembly 115 of FIGS. 4–10 has a variety of advantages noted herein, yet the search continued for a new a manner of reducing the capping forces, while still applying an adequate printhead seal and accommodating manufacturing tolerance stack. In response to this quest for a flexible capping system, capable of balancing and achieving these goals, the foam-filled cap 200 was conceived. The foam-filled cap 200 may be constructed using principles similar to those illustrated with FIGS. 2 and 3, using a single frame to support plural caps 200, or using separate bases 118 for each cap, as described with respect to FIGS. 4–10.

An intermediary cap design was proposed using a one-step foaming process to produce the cap. In this process, an elastomer material was foamed upon introduction into a mold, with the elastomer forming a skin at the surface of the mold. Unfortunately, the caps formed by this one-step foaming process often had porosity at the skin, so these caps failed to produce a reliable seal at the printheads. Furthermore, in this one-step foaming process, it was very difficult to control the porosity of the foam behind the skin, particularly when the attention of the manufacturing process was directed toward forming the skin. Thus, in this one-step foam process, there was virtually no ability to vary the wall thickness of the skin, or to otherwise customize the nature of the skin, without also effecting the material properties of the foam. Finally, the major disadvantage of caps formed using this one-step foaming process is the lack of manufacturing consistency from part to part, leading to a high scrap out rate as parts failed to meet quality standards, which then led to an ultimate higher price of those parts which did pass quality standards.

The foam cap 200 may be manufactured as described further below for use with a unitary flexible frame structure 82 of FIGS. 2–3, or with the frame base 218, using the venting schemes described with respect to FIGS. 4–10. The foam-filled cap 200 is a two-layer structure, with one layer being an elastomeric skin 215 formed to define an interior cavity 216, which is filled with a second layer comprising a foamed elastomer network or core 220. Preferably, this skin 215 and the foam core 220 are both formed of the same materials as described above for caps 100–106, and preferably of an EPDM elastomer, with the skin hardened to a durometer of 25 to 80 or higher on the Shore A scale, or preferably between a range of 30–50, or even more preferably between a range of 35–45, on the Shore A scale.

In the past, cap durometer selection was a very tight design criteria, limited to a small range, which in turn unfortunately limited the selection of different types of materials that could be used to form the earlier caps discussed in the Background section above. The properties of the thin skin 215 does not appreciably effect the overall defection of the composite cap 200, which advantageously allows many different types of materials or compounds to be used for the thin skin material. Using the foam material for core 220 no longer requires that the skin material have a certain durometer for effective sealing because now, the modulus of elasticity for the composite cap 200 is a design parameter controlled primarily by the density of the foam core 220, rather than solely an inherent property controlled by the skin material. For the illustrated off-axis inkjet printheads 70–76, one desired range of deflection for the composite cap 200 would be about 0.5 mm (millimeters) deflection per 450–800 grams (about 1.0–1.5 pounds) of force. Additionally, the thin skin 215 isolates the foam core 220 from contact with any ink residue from the printheads, which advantageously allows the use of materials which otherwise may not be compatible with inkjet inks, such as flouroelastomers, silicone, urethanes, etc.

The exterior portions of the foam-filled cap 200 are similar to those described above with respect to cap 100, best shown in FIGS. 4 and 5. For instance, the skin 215 has an upper surface 222 which projects upwardly to seal around the printhead 70. The cap 200 also has a lower surface 224 formed by portions of both skin 215 and the foam core 220, with this lower surface 224 contacting the upper surface of the frame bases 82, 218. The skin upper exterior surface 222 is contoured to define a generally rectangular shaped sealing chamber 225, defined by an opposing pair of longitudinal sealing lips 226, 228 and an opposing pair of lateral sealing lips 230, 232. Each of the exterior surface components 222–232 seal the orifice plate surrounding the nozzles of printhead 70, as described above for components 122–132, respectively, of the high deflection cap 100. The skin 215 defines a vent hole 234 therethrough, which may be constructed to be flush with a bottom surface of the sealing cavity 225, or preferably, the vent hole 234 is surrounded by an optional entry neck portion 235, which may configured as described above for neck 145 shown in FIGS. 4–5 to achieve the same advantages previously noted, such as to retain ink within the sealing chamber 225. In illustrated cap 200, the foam core 220 extends underneath each of the longitudinal side walls 226, 228, as well as underneath the lateral walls 230, 232.

Figure 11:
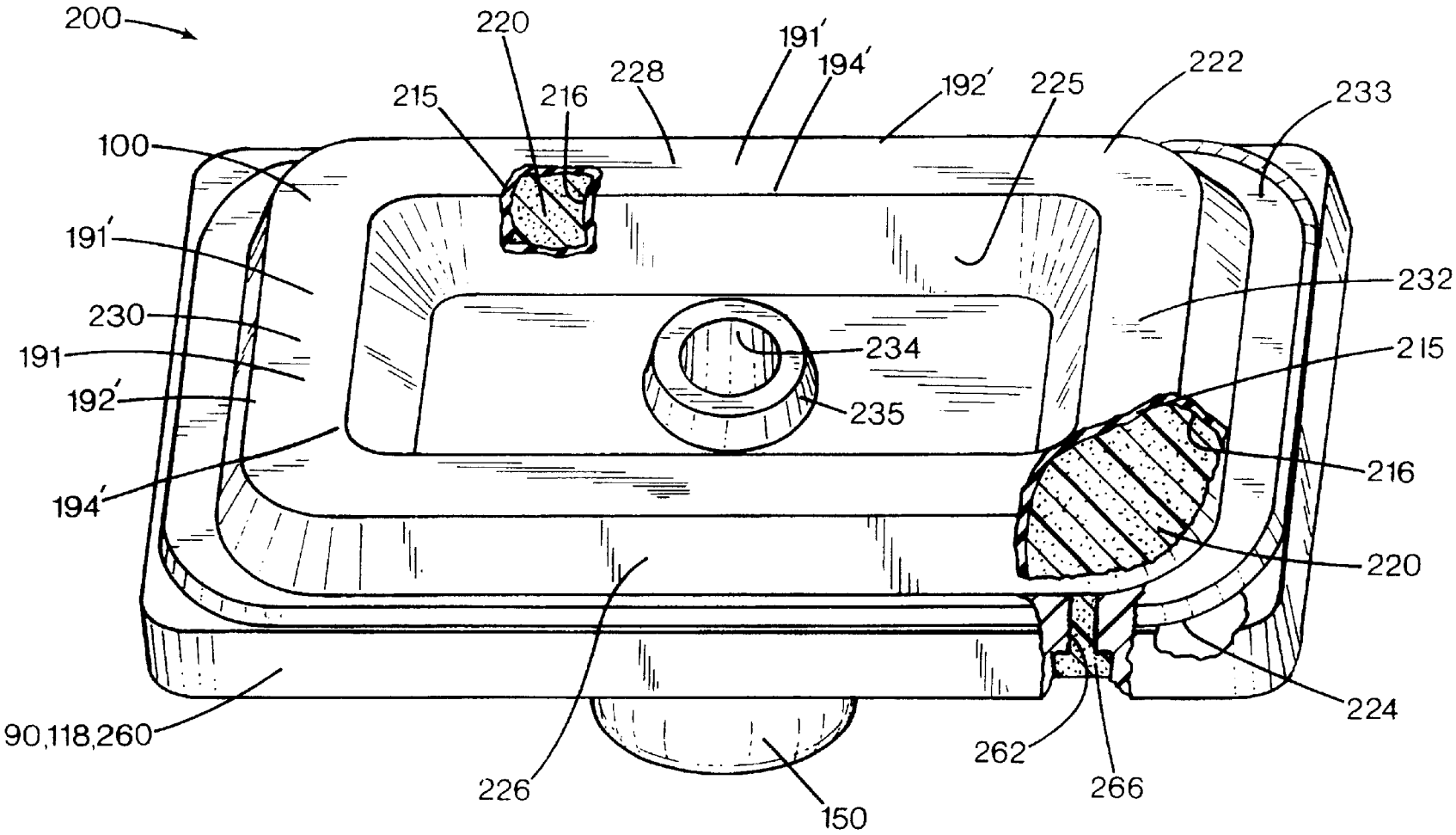
FIG. 11 is an enlarged perspective view of an alternate manner of constructing a cap, here a foam-filled cap for another form of the capping system of the present invention.
Figure 12:
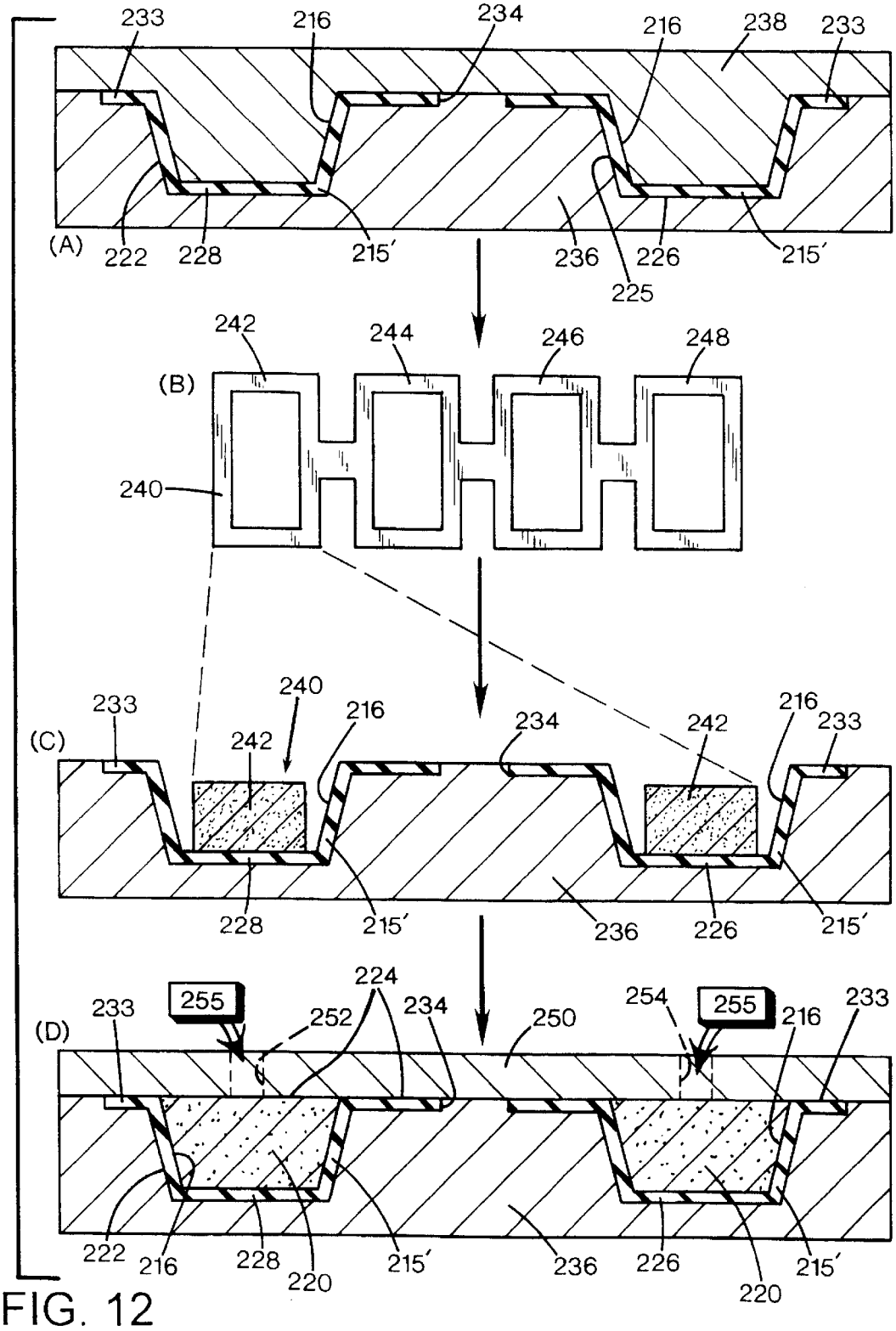
FIG. 12 is a process diagram showing steps A, B, C and D to illustrate different manners of manufacturing the foam-filled cap body of FIG. 11.

FIG. 12 illustrates one manner of constructing the foam-filled cap 200, with subparts A, B, C and D illustrating different steps in the manufacturing molding process, with the cap 200 being formed upside down with respect to the view of FIG. 11. In step A of FIG. 12, the skin 215' is shown being formed between a lower mold cavity or die 236 and an upper mold cavity or die 238, here, with the skin 215' not having the optional neck 235 surrounding the vent opening 234, but with minor modification to dies 236, 238, it is apparent that such a neck could be formed in step A (e.g. see FIG. 13A). The skin 215, 215' may be formed using a variety of different techniques known to those skilled in the art, such as injection molding, thermoplastic injection molding methods using thermoplastic elastomer materials (TPEs), traditional thermoset molding methods using thermosetting elastomer materials, liquid injection molding (LIM) of thermoset silicone LIM materials, transfer molding, compression molding, etc.

Thus, step A of FIG. 12 shows the first layer of cap 200 as being formed to create skin 215'. To form the foam core 220 behind the sealing lips of skin 215, a foam preform 240 may be die-cut from a sheet of foam, or separately molded preferably into the shape shown in step B. While steps A, C and D in FIG. 12 illustrate the construction of a single foam cap 200, one preferred manner of constructing cap 200 is to form multiple caps, such as all four caps 100, 102, 104 and 106 (also see FIG. 19) in a single step, which is illustrated schematically in step B where the foam preform 240 has four foam cutouts 242, 244, 246 and 248 which may be used to line the interior cavity 216 of caps 100, 102, 104, 106, respectively. Indeed, forming all four caps 100–106 in a single mold 236, 238 advantageously provides for consistency between the caps and virtually eliminates assembly errors, avoiding potential misalignment of one cap with respect to another cap. As shown by the dashed lines connecting steps B and C in FIG. 12, the preformed foam rectangle 242 is placed within the interior of cavity 216, which was formed in step A. As shown, the foam preform 240 is of a smaller size than the interior space defined by cavity 216.

After the preform 240 has been installed in cavity 216, a new upper mold or die 250 is then brought into contact with lower mold 236. Step D of FIG. 12 comprises a foaming step, where heat is applied to the mold assembly 236, 250 to cause the foam preform 240 to expand into the foam network or core 220. This expansion of the foam preform 240 into the foam core 220 is also illustrated in steps C and D by the close stippled shading of the preform 240 in step C, and by a more sparse stippled shading in step D to show expansion of the preform 240 into the final foam core 220, which fills the voids within cavity 216.

While the foam core 240 may be molded, preferably the rectangles 242–248 are cut from a foam sheet using a die cutting process. By linking each of the preform rectangles 242–248 together as a web of rectangles, the entire foam preform 240 may be readily placed within the cavity 216 of multiple caps, in the illustrated embodiment four caps 100–106. Use of the preform 240 is believed to provide the highest degree of uniformity and cell distribution because the flow distance required for the foam to completely fill cavity 216 is minimized using preform 240, as opposed to other methods which may leave voids within cavity 216. Thus, use of a die-cut preform 240 not only eases manufacturing, by providing for fewer assembly steps, but also provides a more reliable finished product for cap 200, which ultimately results in more reliable operation of printer 20.

While the foam preform 240 is preferred, advances in technology and molding methods may ultimately favor use of other manufacturing processes, such as an injection process, for transferring the foam 220 into cavity 216. As illustrated schematically in step D of FIG. 12, an alternative injection foam molding process may be accomplished using gates, such as gates 252, 254 formed within the upper die 250, to inject a raw foam 255 into cavity 216. In such a foam injection process, more even flow of the foam material through the cavity 216 may be achieved by using minimal flow lengths, provided by using multiple gates 252, 254, because the foam material immediately begins to expand as it is injected into the cavity. For example, for a 50% fill capacity, a volume of raw or uncured foam equal to 50% of the volume of cavity 216 is injected, with the foam then being required to flow and expand to fill the remaining portions of the cavity. Currently, this foam injection process is difficult to control, and injecting differing amounts of foam into a cavity often results in differing foam densities in the final core 220. Differing foam densities may translate into non-uniform sealing properties as the cap lips 226–232 are brought into contact with the printheads 70–76. Uneven capping forces may lead to an inadequate seal, or if a hard spot formed in the foam, possible damage to the printhead orifice plate may occur. However, many of these concerns may be addressed by more fully studying the relevant molding factors, such as gating geometries, or through use of multiple gating schemes. Alternatively, it is apparent to those skilled in the art that blowing agents may also be used to achieve this same foaming effect to produce core 220. Advantageously, steps A–D of FIG. 12 may be accomplished using a single lower mold half 236 in a shuttle system which progresses the die through different manufacturing stages, or by holding the lower die 236 stationary, and moving the other dies in and out of position during the molding process.

The process of FIG. 12, as well as the other processes described herein, may be modified slightly to form the skin from a film sheet which lines the cavity of the lower mold 236 prior to insertion of the foam preform 240, or prior to injection of the foam 255. This film sheet skin layer is preferably of a thermally stable film selected to withstand the curing or process cycle of the foaming step D, such as of a polyethylene, Saran®, polyvinylidene chloride, polypropylene, Teflon®, and the like. During step D, the foaming heating process bonds or adheres the foam 220 to the film skin. Alternatively, this film process may use a thin sheet of an elastomer, such as those listed previously, and preferably using an EPDM elastomer film sheet.

Figure 13:
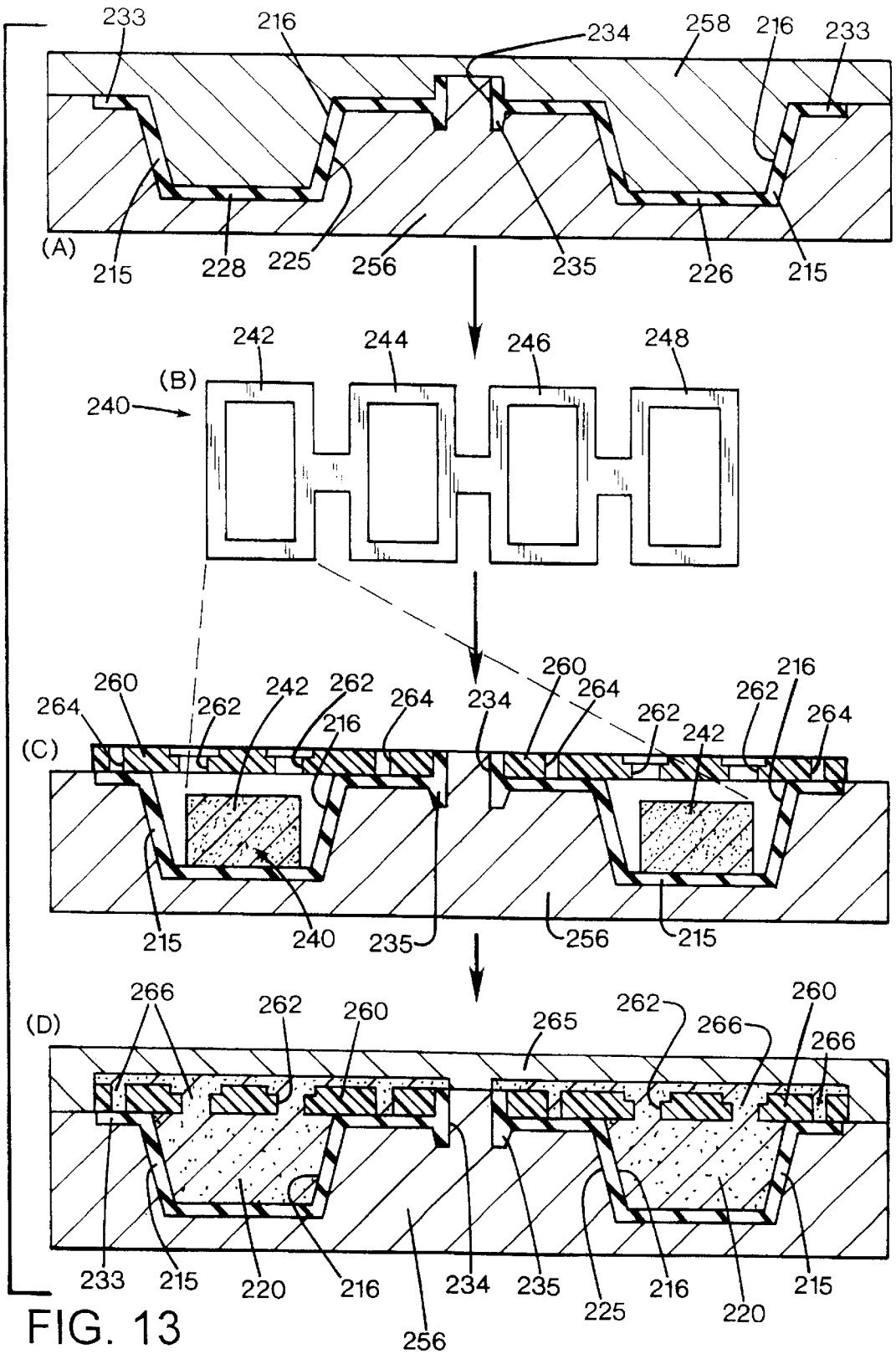
FIG. 13 is a process diagram showing steps A, B, C and D to illustrate another manner of manufacturing the foam-filled cap body of FIG. 11.

FIG. 13 shows an alternate manner of manufacturing the foam-filled cap 200 in accordance with the present invention. In FIG. 13, the optional neck 235 is shown being formed by a lower mold cavity or die 256 and an upper mold cavity die 258, which are otherwise similar in construction to dies 236 and 238 of FIG. 12. To totally line the throat 234 with the elastomer of skin 215, the lower die 256 extends completely through the throat to meet with upper die 258. Otherwise, step A of FIG. 13 is comparable to step A of FIG. 12. Moreover, the discussion concerning the foam preform 240 of step B in FIG. 13 is similar to that of step B in FIG. 12.

The method of FIG. 13 differs from that of FIG. 12 in that an insert 260 is installed in step C of FIG. 13. Here, we see the insert 260, preferably, of a plastic material, or of a metallic material such as described above for frame 82, which fits over the molded skin 215 after the foam insert 240 has been installed in cavity 216. The insert 260 has a group of knit holes 262, 264 therethrough, which serve to bond, mechanically and preferably also chemically, the insert 260 to the foam core 220 and to the skin 215. As shown in step D of FIG. 13, a second upper die 265 is then applied over the insert 260 and the lower die 258, after which the foam preform 242 is heated to expand and fill the voids of cavity 216. The foam preform 242 also expands to fill the knit holes 262, 264, serving to bond the insert 260 to the skin 215 via the knit holes 264, and to the foam network 220 via holes 264, at bond or knit points 266 shown in step D of FIG. 13.

Figure 14:
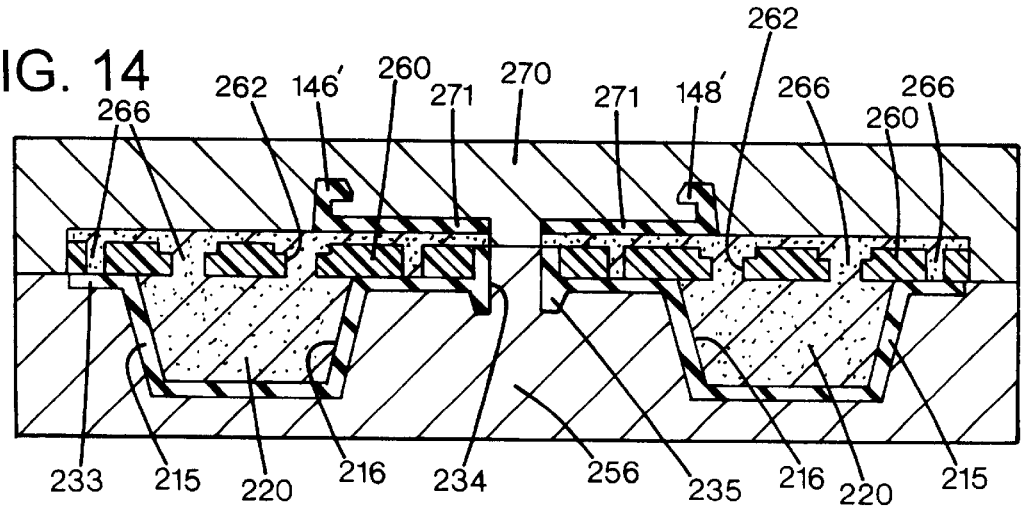
FIG.14 is a process diagram showing a final step which may be used following step D of FIG. 13 to form means for attaching the catch basin portion of the capping system to the foam-filled cap body of FIG. 11.

It is apparent that rather than using the foam preform 240, alternatively the foam core 220 may be formed by injecting raw, uncured foam 255 in step D of FIG. 13 by modifying the upper die 265 to have gates similar to gates 252, 254 of FIG. 12, and by also using knit holes 262 through insert 260 as a portion of the gating system. FIG. 14 illustrates a final optional step in the process of FIG. 13, here illustrated as step E, where a third upper mold cavity die 270 has been placed over knit points 266. The die 270 is fashioned to mold a backing layer 271 and a pair of basin retaining members 146' and 148', which may be of the same construction as illustrated above with respect to FIG. 5, for retaining the vent basin 150.

Figure 15:
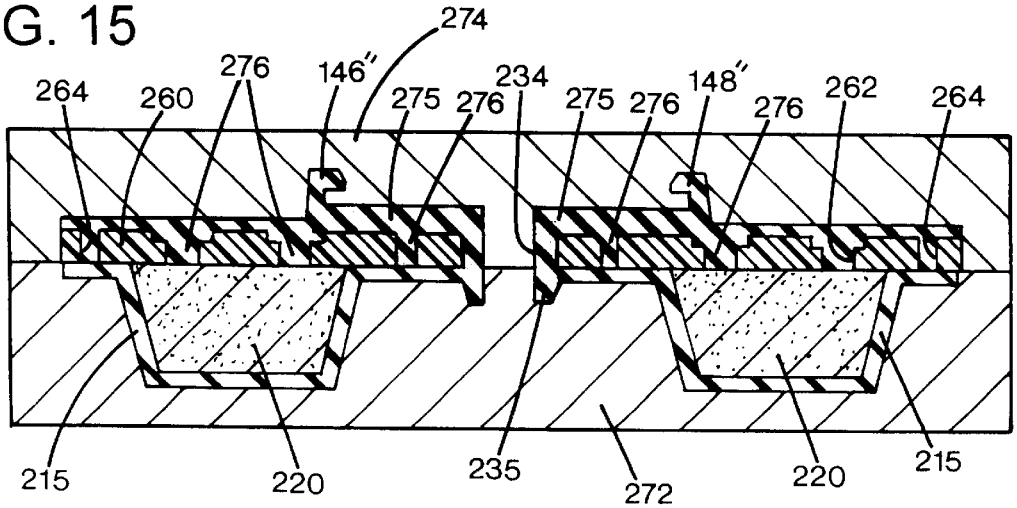
FIG. 15 is a process diagram showing a final step which may be used following step D of FIG. 12 to install an insert member, as well as to form means for attaching the catch basin portion of the capping system to the foam-filled cap body of FIG. 11.

FIG. 15 illustrates an alternate embodiment for forming a pair of basin retaining rims 146" and 148", which may also be of the same construction as illustrated above with respect to FIG. 5, for retaining the vent basin 150. Here, FIG. 15 may be considered as a final step E following the step D of FIG. 12, although the view of FIG. 15 illustrates the forming of the optional neck 235 surrounding vent hole 234. In FIG. 15, die 236 of FIG. 12 has been replaced with a new lower mold cavity die 272 to form neck 235. FIG. 15 also illustrates the optional concept of molding insert 260 into cap 200 using a non-foamed elastomer to secure the insert 260 to the structure, although it is apparent that the dies shown herein may be modified to use skin 215, 215' to secure the insert 260 in place. Following the foaming operation of step D in FIG. 13, using an upper mold cavity die 274, an elastomer backing layer 275, preferably of an EPDM elastomer as used to form skin 215, 215', is used to form the basin retaining rims 146", 148". Here, a group of knit points 276 of the non-foamed elastomer from layer 275 are formed through the knit holes 264, 266 to bond the insert 260 to the foam core 220 and to the skin 215.

By careful selection of the materials for the backing layer 275, insert 260, foam 220 and the skin 215, 215', advantageously, the final basin adhering backing layer 275 advantageously bonds the insert 260 both chemically and mechanically to the skin layer 215 and to the foam network 220. While the basin retaining members 146', 148', 146", 148" are shown being formed in FIGS. 14 and 15, it is apparent to those skilled in the art that other vent systems may be applied to the foam filled capping assembly 200 through mounting of the cap assembly 200 with the service station frame. For example, a variety of venting schemes are noted in the Background section above, and others are shown commercially available inkjet printing mechanisms, although in the preferred embodiment, the vent basin 150 is used, either filled with the absorbent material 158, or left empty.

Figure 16:
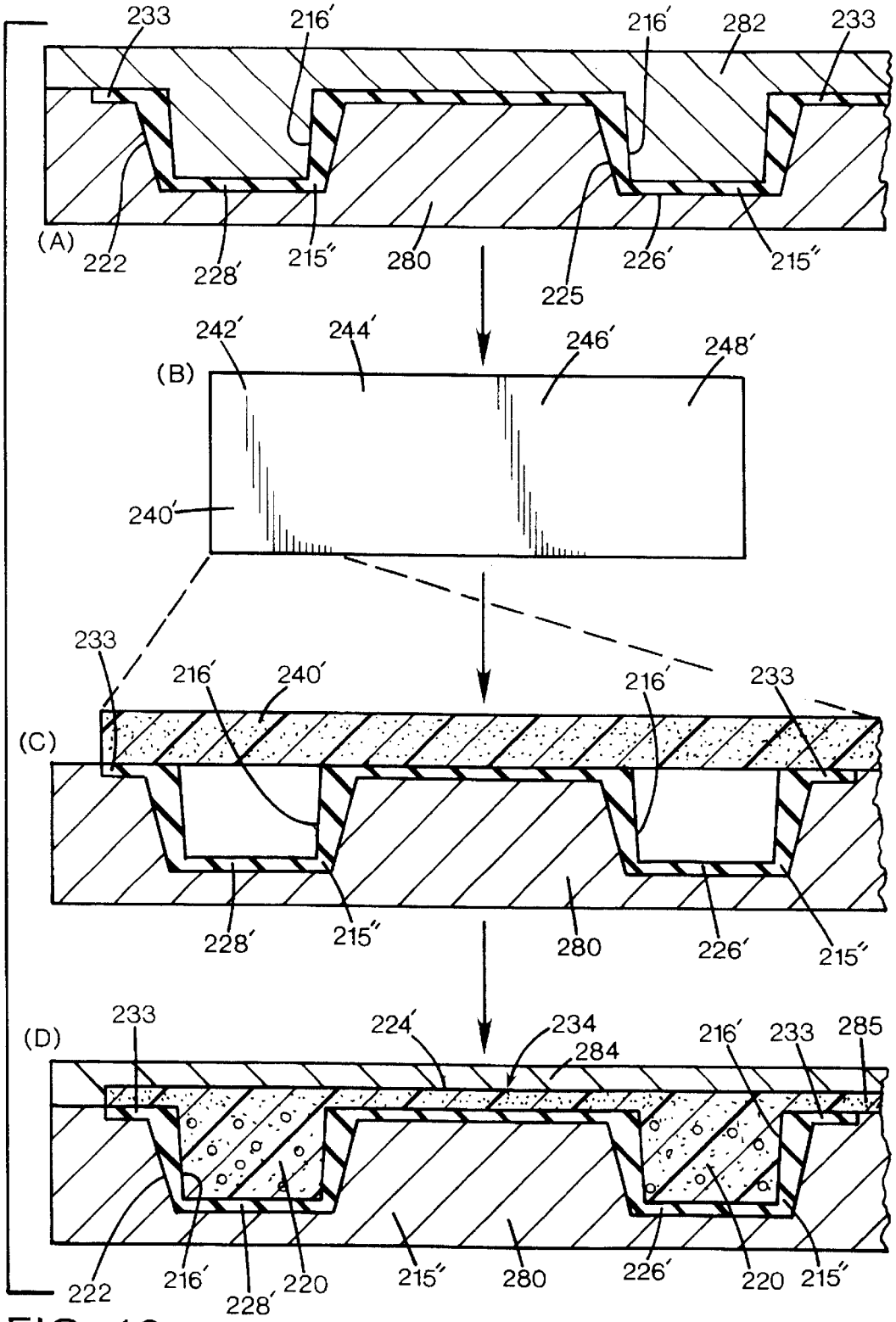
FIG. 16 is a process diagram showing steps A, B, C and D to illustrate an additional manner of manufacturing the foam-filled cap body of FIG. 11.

FIG. 16 illustrates another manner of constructing the foam-filled cap 200, with subparts A, B, C and D illustrating different steps in the manufacturing molding process, with the cap 200 being formed upside down with respect to the view of FIG. 11. In step A of FIG. 16, the skin 215" is shown being formed between a lower mold cavity or die 280 and an upper mold cavity or die 282, here, with the skin 215" not having the optional neck 235 surrounding the vent opening 234. Indeed, In this embodiment, a final finishing operation is preferably preformed where the vent hole 234 is die-cut into the cap bottom after removal from the lower mold 280. The skin 215" may be formed using a variety of different molding techniques as noted above.

Step A of FIG. 12 shows the first layer of cap 200 as being formed to create skin 215". Here, the inner and outer sidewalls of cavity 216' have been thickened near the base to illustrate the use of a non-uniform skin thickness, which may be varied to tailor the force deflection properties of the composite cap 200. To form the foam core 220 behind the sealing lips of skin 215, a single sheet foam preform 240' has four foam cap regions 242', 244', 246' and 248' which may be used to line the interior cavity 216, 216' of caps 100, 102, 104, 106, respectively. Indeed, several groups of cap assemblies for several different printer units may be formed in a single mold, then separated through the same die-cut process used to form the vent holes 234 following removal of the skin from die 280 after step D is complete. As shown by the dashed lines connecting steps B and C in FIG. 16, the portion 242' of the foam preform 204' is placed along the upper surface of the die 280 over skin 215".

After the preform 240' has been installed, a new upper mold or die 284 is then brought into contact with the foam preform sheet 240' and pressed into molding contact with lower mold 280. Step D of FIG. 16 comprises a foaming step, where heat is applied to the mold assembly 280, 284 to cause the foam preform 240' to expand into the foam network or core 220. The compression of the foam 240' in regions 285 of step D is illustrated by the close stippled shading, whereas the expansion into the cavity 126' is shown as a more sparse stippled shading in step D. Use of a single preform sheet 240' may be preferred over the contoured preform 240 of FIGS. 12 and 13, do to ease of forming and handling sheet 240', as compared to forming and aligning the cut web of preform 240.

Figure 17:
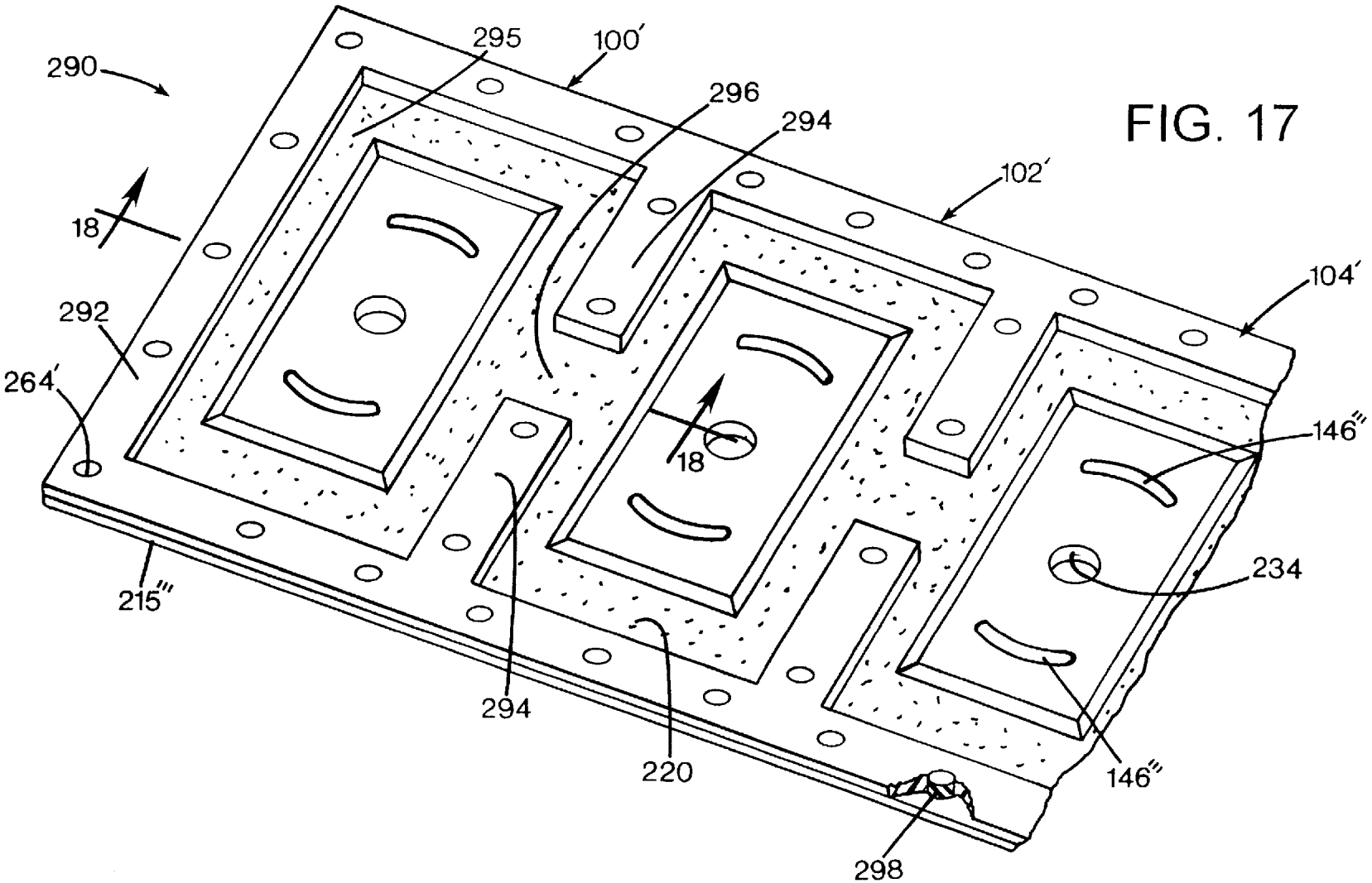
FIG. 17 is a fragmented, enlarged perspective view of an alternate manner of constructing the capping system of the present invention, using a series of foam-filled cap bodies for sealing inkjet printheads within the printer of FIG. 1.
Figure 18:
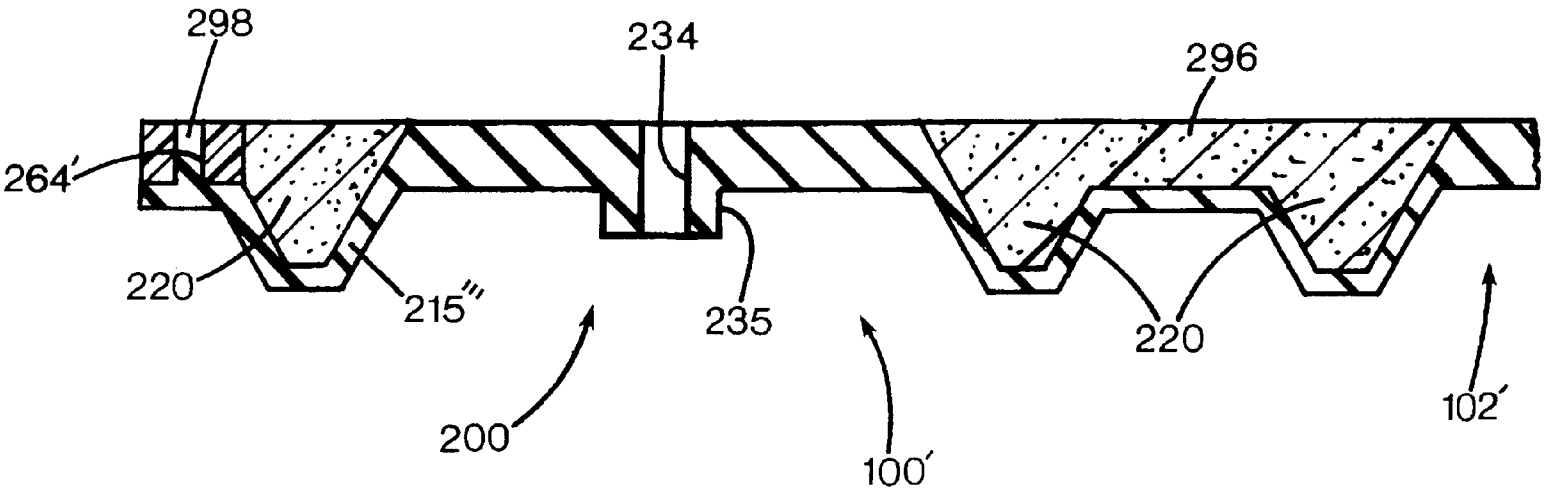
FIG. 18 is an enlarged, front elevational, sectional view taken along line 18—18 of FIG. 17.

Now that the alternative manners of forming the foam-filled cap 200 are understood, an alternative manner of installing the foam caps 200 into printer 20 will be described with respect to FIGS. 17 and 18, which illustrate one preferred embodiment of a multi-cap assembly 290 constructed in accordance with the present invention. As mentioned above, to decrease the number of parts required to form a capping assembly to seal printheads 70–76 a multiple cap single sled assembly, such as capping assembly 80 shown in FIGS. 2 and 3, is preferred over the separate cap mounting assembly 115 shown in FIGS. 4 and 5. In FIG. 17, three of a group of four foam filled caps 200 are shown as caps 100', 102' and 104'.

The multiple cap assembly 290 may be easily formed by extending the principles described above with respect to FIGS. 12–16 by placing a portion of an insert 292 over the border 233. The insert 292 has several pairs of fingers, such as fingers 294 which separate the cap adjacent regions, such as regions 100' and 102'. The cap assembly 290 also has foam cores 20 for each cap which may be assembled using a unitary preform 295, shown prior to expansion in FIG. 17, and shown after expansion in FIG. 18. Advantageously, the insert fingers 294 of each pair have distal ends which are separated from one another to define a passageway therethrough for interconnecting the foam cores 220 of the adjacent caps, such as 100' and 102', via a link portion 296 of the foam preform 295. The insert 292 is also formed with a series of knit holes 264' therethrough, with knit points 298 being formed when skin 215'''. is initially molded. Venting provisions may be provided underneath the multiple cap assembly 290 by forming retained by rims 146''' and 148''' when the skin 125''' is molded, to retain basin 150 as described above.

Now that the alternative manners of forming the foam-filled cap 200 are understood, an alternative manner of installing the foam caps 200 into printer 20 will be described with respect to FIG. 19, which illustrates another preferred embodiment of a multi-cap assembly 300 constructed in accordance with the present invention. As mentioned above, to decrease the number of parts required to form a capping assembly to seal printheads 70–76 a multiple cap single sled assembly, such as capping assembly 80 shown in FIGS. 2 and 3, is preferred over the separate cap mounting assembly 115 shown in FIGS. 4 and 5. Use of an insert 260 which extends across a mold cavity for forming four foam-filled caps 200 to seal printheads 70–76 may be easily accomplished, for instance, using the flexible frame assembly 82. Unfortunately, the use of inserts increases the cost of the molding process, and thus the cost of the ultimate finished part. Thus, it may be desirable to form the foam-filled cap 200 without insert 260 as illustrated in FIG. 12, using the multi-cap construction 300 of FIG. 19.

Figure 19:
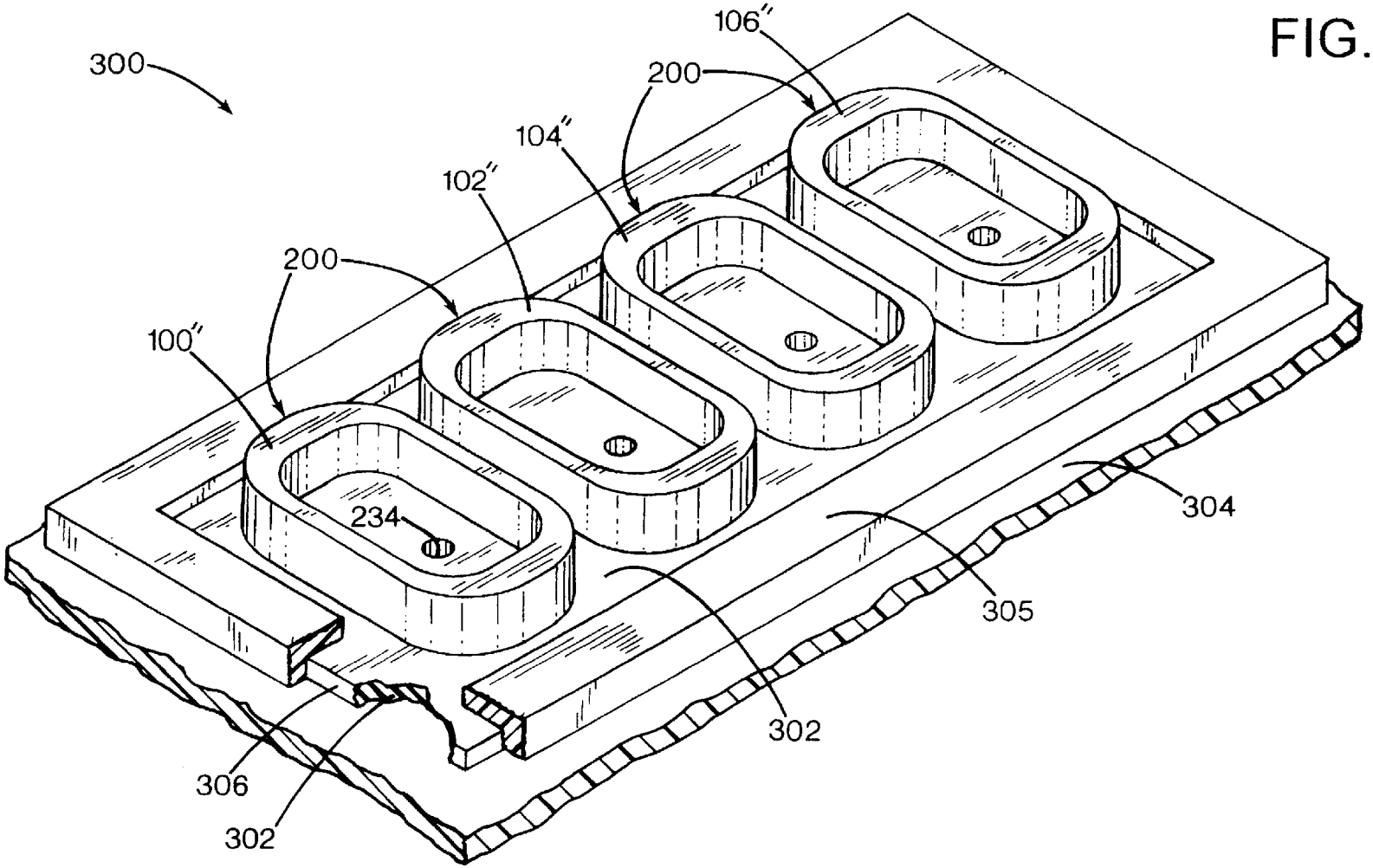
FIG. 19 is an enlarged perspective view of an alternate manner of constructing the capping system of the present invention, using a series of foam-filled cap bodies for sealing inkjet printheads within the printer of FIG. 1.

In FIG. 19, the foam filled caps 200 are formed in a group of four, here shown as caps 100', 102', 104' and 106', to seal the printheads 70, 72, 74 and 76. The multiple cap assembly 300 may be easily formed using the principles described above with respect to FIG. 12 by extending border 233 into a border blanket 302 which is placed upon a portion of a service station cap support platform 304. Venting provisions may be provided underneath the multiple cap assembly 300, for instance using basin 150 retained by rims 146', 148' or 146", 148", which may be formed by slightly modifying dies 270, 274 to be used without insert 260 or by providing a feature in the cap platform 304 to serve as a vent. A variety of other venting mechanisms may also be used as noted above. For instance, to hold the vent basin 150 in place, a pair of retaining rims (not shown) similar to rims 146 and 148 may be molded to extend from the lower surface of the insert. To secure the cap assembly 300 to the service station cap platform 304, preferably a hold down member 305 is used to surround a periphery 306 of the border blanket 302. The manner of attaching the hold down member 305285 to the service station cap platform 304 may be accomplished in a variety of ways known to those skilled in the art, such as through the use of interlocking snap fits, or by bonding as illustrated, such as with an adhesive, or using fastener means, such as screws and the like, or using a variety of other known attachment schemes.

Conclusion

A variety of advantages are realized using the capping systems 100, 160 and 200, such as the ability to easily mold the cap body 120. The elimination of the multiple ridge lip concept used in the earlier designs provides a cap that is easier to mold, and indeed, may be economically manufactured by a variety of vendors. This design then allows the printer manufacturer to obtain viable part price quotations from more vendors, to obtain a better cap price, a savings which may then be passed on to the consumer. The multiple ridged lips occasionally had problems with debris becoming trapped between the ridges, with a resulting decline in sealing performance, a problem which advantageously disappears when using the capping systems 100, 160 and 200

Besides leakage control, discussed above, a further advantage of constructing the chamber 125 with a continues elastomeric body is the prevention of unwanted leakage between the elastomer lips and the cap support, as experienced in the earlier models discussed in the Background section above. The earlier printers had to use higher capping forces to not only seal the lips at the printhead, but also to seal the lip/sled interface where the support sled formed a portion of the sealing cavity. Indeed, the illustrated hollow cavity cap 100 only needs a capping force on the order of 75% of that required by these earlier printers to adequately seal the printhead. Thus, there is no need to over-design both the printhead and the cap support structure to seal the printhead using caps 100–106. Furthermore, by using onsert molding techniques, the cap is permanently referenced relative to the support frame and the pen alignment datums on the frame, within much tighter tolerances as opposed to earlier cap designs that used a separate cap lip expanded to fit over a carrier. These earlier designs unfortunately often slipped from their positions on the carrier, twisting or turning relative to the carrier frame leaving some nozzles uncapped. Use of the stitch points 107 and the associated onsert molding techniques, in addition to the deflection cavities 134, 135 produces a reliable, efficient and cost effective capping system.

Use of the catch basin 150, particularly when filled with the hygroscopic material soaked pad 158, advantageously handles ink spills and moisture accumulation while maintaining a humidified environment when the printhead is sealed. The capillary vent path provided by the rim portion of the catch basin, as shown in FIGS. 9 and 10, prevents depriming the nozzles as sealing is initiated. Furthermore, use of the gripping ridges, such as 146 and 147, formed along the lower surface 124 of the cap body 120 aids in easily assembling the basin 150 to the cap body, particularly when using automated techniques to construct the embodiment of system 160.

A further advantage of the cap body 120 is the ability to adapt the design to a variety of different support structures, such as the metallic flexible frame 82 and the plastic frame 118. As discussed at length above with respect to FIG. 7, the high deflection lips 130, 132 are capable of providing a superior seal, not only over a relatively flat portion of a printhead, but also over significant surface irregularities, such as the encapsulant bead 190. In making these seals, the central portion of the lips 130, 132 deflects downwardly into the deflection cavities 135, 134, forming a smiling shape when viewed in cross section as shown in FIG. 7. The two extreme edges of this smile-shaped deflection form a dual seal 192, 194 along the interior and exterior edges of the lips 130, 132. Thus, the sealing capabilities of the earlier multiple ridged cap lips is achieved using the capping systems 100, 160 and 200, while avoiding the pitfalls of those earlier designs, to provide consumers with a more reliable, robust and economical printing unit 20.

A variety of advantages are also realized using the foam-filled cap 200, whether constructed as a single cap and mounted on a base unit 118, or as a multi-cap assembly 300 shown in FIG. 19, or one assembled on a flexible frame 82, as shown in FIGS. 2 and 3. One advantage of the foam-filled cap assembly 200 is its enhanced performance capabilities over a solid elastomer cap. Separately forming the skin 215, 215' and then filling the cavity 216 with foam core 220 to provide a two-layer structure advantageously provides a consistent non-porous sealing surface at lips 226–232, which was not possible using a one-step foaming process, as described above. Additionally, the foam-filled cap 200 advantageously seals over surface irregularities, such as encapsulant bead 190 with edges 192', 194' of sealing surface 191' of lips 226–232 in the manner as described above with respect to FIG. 7, which also avoids the molding problems associated with the earlier multiple lip designs, described above.

Furthermore, by separately molding the skin 215, 215', followed by the separate process of forming the foam core 220, both skin 215, 215' and core 220 may be independently optimized to enhance the sealing ability of cap 220. For instance, the thickness of the skin may be varied to accomplish different sealing objectives, for instance, by having a thinner wall at the lateral regions 230, 232 which have to seal over encapsulant beads 190, and perhaps a thicker wall for the lateral walls 226, 228 which seal along a relatively longer portion of the printheads 70–76. One main advantage of the foam-filled cap 200 is the ability to provide an adequate seal over a broad range of manufacturing tolerances, while reducing the capping forces experienced by printheads 70–76 over that of previous capping systems. This superior seal is achieved by the ability of cap 200 to be compressed to accommodate various manufacturing tolerances between the pens 50–56, carriage 45, and the service station itself, while also being compliant enough to seal the printheads.

As a further advantage, by selecting the skin 215, 215' and the foam core 220 to be of the same material, during the foaming process of step D in FIGS. 12 and 13, the foam core may molecularly bond with the skin to form a unitary structure. Moreover, during the process of molding in insert 260, the material of foam core 220 or layer 275 may be selected to not only physically bond at the knit points 266, but also to chemically bond with the insert 260.

One key aspect of the two-layer foam cap 200 is its composite nature. As a composite, both the skin and the foam core 220 may be modified and designed to enable capabilities of a cap that are not available if only a single element is used to produce a cap. For example, the material that seals against the orifice plate has certain sealing, and ink compatibility requirements. In the past, a solid EPDM elastomer cap was used because of its ability to seal and resist ink attack. As the requirements of the cap increase in terms of sealing performance, ink compatibility, and force/deflection performance, a single material solution for a cap is limited in its ability to meet all of these competing requirements. The main problem encountered with the earlier solid elastomer caps was meeting the increasing force/deflection demands. As mentioned in the Background section above, a foam cap produced in a single step, rather than the skin first followed by foam process of FIGS. 11–19, failed to meet the performance requirements and the process lacked consistency; however it is apparent that further enhancements to the molding processes may be developed in the future to the point where a one step process may be used to manufacture a suitable foam cap 200 having the features described herein.

The ability to separately form the solid skin and the foam core of cap 200 provides nearly infinite design flexibility to meet sealing, ink compatibility, and force/deflection requirements. For instance, varying the wall thickness of the skin, as shown in FIG. 16, meets sealing and force deflection goals by fine tuning the air and vapor transmission rates through the skin, while also providing design freedom in terms of how the cap seals against the orifice plate of the pen. For example, the cap lips 226, 228, 203 and 232 may be formed to have thicker areas at the inner and outer edges and thinner areas in the center, to enhance the "smiling feature" shown in FIG. 7 for increased seal performance. Furthermore, the force deflection of the cap 200 may be altered by using varying thickness in different areas of the skin. Additionally, the processes for forming both the skin and the core may be individually optimized since they are formed in two different molding steps, leading to an optimal design for the composite foam-filled cap 200.

As mentioned above, use of a multiple cap assembly 300, or when several caps 200 are implemented on flexible frame 82, advantageously decreases the number of parts required to assemble the service station, and thus to assemble printer 20. Fewer parts advantageously reduces the assembly costs, while also reducing related costs such as fewer parts to be ordered, inventoried, and tracked. Additionally, if future designs require study of different cap deflection properties, modifications to the illustrated design of cap 200 may be easily made, such as changes to the skin material, durometer, geometry, or other variables, and these changes may be made independent of such changes to the foam core 220. Thus, the foam filled cap 200 has a design flexibility not previously possible using the earlier proposed one-step foamed cap. Additionally, by providing separate design control over the skin 215, 215' and over the foam core 220, other factors may also be adjusted, such as to enhance the compression-set performance of the material. Thus, use of the foam-filled cap 200 advantageously allows design flexibility, enhanced performance capability, and fewer parts to inventory and track, leading to fewer assembly steps to manufacture the inkjet printer 20, all of which lead to a more economical and reliable inkjet printer unit for consumers.

We claim:

1. A cap for sealing ink-ejecting nozzles of an inkjet printhead in an inkjet printing mechanism, comprising:

a flexible skin layer having an exterior surface and an interior surface, with the exterior surface defining a sealing lip to surround the ink-ejecting nozzles when said cap is in a sealing position and to define a sealing chamber, with the interior surface of the skin layer defining a cavity under at least a portion of the sealing lip; and a foam core within the cavity.

2. A cap according to claim 1, further including an insert sandwiching the foam core between the skin layer and the insert.

3. A cap according to claim 2 wherein the insert is of a substantially rigid material.

4. A cap according to claim 3 wherein the insert is of a plastic material.

5. A cap according to claim 2 wherein the insert has a plurality of knit holes therethrough, and the insert is mechanically bonded to at least one of the foam core and the skin layer at said knit holes.

6. A cap according to claim 2 wherein the insert is chemically bonded to at least one of the foam core and the skin layer.

7. A cap according to claim 2 wherein:

the insert has a plurality of knit holes therethrough;

the insert is mechanically bonded to at least one of the foam core and the skin layer at said knit holes; and the insert is chemically bonded to at least one of the foam core and the skin layer.

8. A cap according to claim 2 wherein the insert is bonded by a portion of the foam core to sandwich the foam core between the skin layer and the insert.

9. A cap according to claim 8 wherein the insert has a plurality of knit holes therethrough and said portion of the foam core extends through said knit holes.

10. A cap according to claim 8 further including:

the skin layer defining a vent hole therethrough from the exterior surface to the interior surface;

the cap further includes a vent member adjacent the interior surface of the skin layer at the vent hole and in fluid communication therewith; and a backing layer of an elastomer supported by said portion of the foam core, with the backing layer defining a vent member attachment that secures the vent member adjacent the vent hole.

11. A cap according to claim 10 wherein the vent member includes a mounting rim, and vent member attachment of the backing layer comprises a pair of gripping members that resiliently grip the vent member mounting rim.

12. A cap according to claim 2 wherein:

the insert has a plurality of knit holes therethrough; and the cap further includes a backing layer of an elastomer sandwiching the insert between said backing layer and the foam core, with a portion of the backing layer extending through said knit holes to bond the insert to at least one of the foam core and the skin layer.

13. A cap according to claim 12 further including:

the skin layer, insert and backing layer together define a vent hole therethrough from the sealing chamber;

the cap further includes a vent member having a mounting rim, with the vent member in fluid communication with the vent hole; and a vent member attachment defined by another portion of the backing layer to resiliently grip the vent member mounting rim to secure the vent member adjacent the vent hole.

14. A cap according to claim 1 wherein the skin layer defines a vent hole therethrough from the exterior surface to the interior surface, with the skin layer also defining a neck surrounding the vent hole and projecting from the exterior surface into the sealing chamber.

15. A cap according to claim 1 further including:

a backing layer of an elastomer sandwiching the foam core between the skin layer and said backing layer;

the skin layer and backing layer together defining a vent hole therethrough in fluid communication with the sealing chamber;

a vent member having a mounting portion, with the vent member in fluid communication with the vent hole; and a vent member attachment defined by a portion of the backing layer to resiliently grip the vent member mounting portion to secure the vent member adjacent the vent hole.

16. A cap according to claim 1 wherein the cavity extends totally under the sealing lip to surround the sealing chamber, with the cavity filled throughout with the foam core.

17. A cap according to claim 1 wherein:

the skin layer is of an elastomer; and the foam core is of a foamed elastomer of the same type of elastomer as the skin layer.

18. A cap according to claim 1 wherein the skin layer extends around a periphery of the sealing lip to define a border portion, and the cap further includes a border member overlying the border portion of the skin layer to serve as a mounting member to secure the cap to a service station cap platform.

19. A cap according to claim 1 wherein the lip has a sealing region that is substantially planar before sealing the printhead, with the sealing region overlaying the foam core and having a central portion bordered by two opposing bands, and with the central portion of the sealing region deflecting into and compressing the foam core when in the sealing position so the two opposing bands substantially form a seal against the printhead in the sealing region of the lip.

20. A cap according to claim 1 wherein the flexible skin layer is of an elastomeric material.

21. A cap according to claim 1 wherein the flexible skin layer is formed of a film sheet.

22. A cap according to claim 21 wherein the film sheet is of an elastomeric material.

23. A cap according to claim 21 wherein the film sheet is of a material selected from the group consisting of polyethylene, Saran®, polyvinylidene chloride, polypropylene, and Teflon®.

24. A method of constructing a printhead cap for sealing ink-ejecting nozzles of an inkjet printhead in an inkjet printing mechanism, comprising the steps of:

molding a flexible skin layer having an exterior surface and an interior surface, with the exterior surface defining a sealing lip to surround the ink-ejecting nozzles when said cap is in a sealing position and to define a sealing chamber, with the interior surface of the skin layer defining a cavity opposite at least a portion of the sealing lip; and foaming an elastomer within the cavity to form a foam core therein.

25. A method according to claim 24, wherein the foaming step comprises injecting a raw elastomer foam into the cavity, then expanding the raw elastomer foam to substantially fill the cavity.

26. A method according to claim 24, wherein the foaming step comprises installing a foam preform over the skin layer, then expanding the foam preform to substantially fill the cavity with the foam core.

27. A method according to claim 26 further including the step of, prior to the installing step, cutting the foam preform from a sheet of foam material into a shape which fits into the cavity, and wherein the installing step comprises placing the cut foam preform into the cavity.

28. A method according to claim 26, wherein the expanding step comprises the step of heating the foam preform.

29. A method according to claim 24 further including the step of molding an insert to at least one of the foam core and the skin layer.

30. A method according to claim 29 wherein:

the insert defines plural holes therethrough; and the foaming step comprises injecting a raw elastomer foam into the cavity through at least one of the plural holes through the insert, then expanding the raw elastomer foam to substantially fill the cavity and permeate through said plural holes of the insert to accomplish said step of molding the insert.

31. A method according to claim 30 further including the step of molding a backing layer of an elastomer to bond with a portion of the elastomer which permeated said plural holes of the insert.

32. A method according to claim 29 wherein:

the insert defines plural holes therethrough; and the method further includes the step of molding a backing layer of an elastomer to sandwich the insert between the backing layer and the foam core, with a portion of the backing layer elastomer permeating through said plural holes of the insert to bond with at least one of the skin layer and the foam core to accomplish said step of molding the insert.

33. A method according to claim 32 wherein:

the skin layer, insert and backing layer are molded together to define a vent hole therethrough in fluid communication with the sealing chamber; and step of molding the backing layer includes the step of molding a vent member attachment with a portion of the backing layer elastomer to resiliently grip a vent member in a position for fluid communication with the vent hole.

34. A method according to claim 29 wherein:

the insert defines plural holes therethrough; and the foaming step comprises installing a foam preform in the cavity, then expanding the foam preform to substantially fill the cavity with the foam core and permeate a portion of the foam core through said plural holes of the insert to accomplish said step of molding the insert.

35. A method according to claim 34 further including the step of molding a backing layer of an elastomer to bond with a portion of the foam core which permeated said plural holes of the insert.

36. A printhead cap constructed according to any of the methods of claims 24 through 35.

37. A method according to claim 24, wherein the molding step comprises molding the flexible skin layer of an elastomeric material.

38. A method according to claim 24, wherein the molding step comprises placing a film sheet in a mold.

39. A method according to claim 38, wherein the placing step comprises placing a film sheet of an elastomeric material in the mold.

40. A method according to claim 38, wherein the film sheet of the placing step is of a material selected from the group consisting of polyethylene, Saran®, polyvinylidene chloride, polypropylene, and Teflon®.

41. An inkjet printing mechanism, comprising:

an inkjet printhead having ink-ejecting nozzles;

a carriage that reciprocates the printhead through a printzone for printing and to a servicing region for printhead servicing; and a capping system in the servicing region for sealing the printhead nozzles during periods of inactivity, with the capping system including a cap support platform moveable to a sealing position, and a printhead cap supported by the cap support platform, with the printhead cap comprising:

a flexible skin layer having an exterior surface and a interior surface, with the exterior surface defining a sealing lip to surround the ink-ejecting nozzles when in the sealing position and to define a sealing chamber, with the interior surface of the skin layer defining a cavity under at least a portion of the sealing lip; and a foam core within the cavity.

42. An inkjet printing mechanism according to claim 41 wherein the cap further includes an insert sandwiching the foam core between the skin layer and the insert.

43. An inkjet printing mechanism according to claim 42 wherein the insert has a plurality of knit holes therethrough, and the insert is mechanically bonded to at least one of the foam core and the skin layer at said knit holes.

44. An inkjet printing mechanism according to claim 42 wherein the insert is chemically bonded to at least one of the foam core and the skin layer.

45. An inkjet printing mechanism according to claim 42 wherein the insert is bonded by a portion of the foam core to sandwich the foam core between the skin layer and the insert.

46. An inkjet printing mechanism according to claim 42 wherein:

the insert has a plurality of knit holes therethrough; and the cap further includes a backing layer of an elastomer sandwiching the insert between said backing layer and the foam core, with a portion of the backing layer extending through said knit holes to bond the insert to at least one of the foam core and the skin layer.

47. An inkjet printing mechanism according to claim 41 wherein the skin layer defines a vent hole therethrough from the exterior surface to the interior surface, with the skin layer also defining a neck surrounding the vent hole and projecting from the exterior surface into the sealing chamber.

48. An inkjet printing mechanism according to claim 41 further including:

a backing layer of an elastomer sandwiching the foam core between the skin layer and said backing layer;

the skin layer and backing layer together defining a vent hole therethrough in fluid communication with the sealing chamber;

a vent member having a mounting portion, with the vent member in fluid communication with the vent hole; and a vent member attachment defined by a portion of the backing layer to resiliently grip the vent member mounting portion to secure the vent member adjacent the vent hole.

49. An inkjet printing mechanism according to claim 41 wherein the lip has a sealing region that is substantially planar before sealing the printhead, with the sealing region overlaying the foam core and having a central portion bordered by two opposing bands, and with the central portion of the sealing region deflecting into and compressing the foam core when in the sealing position so the two opposing bands substantially form a seal against the printhead in the sealing region of the lip.

50. An inkjet printing mechanism according to claim 41 wherein the flexible skin layer is of an elastomeric material.

51. An inkjet printing mechanism according to claim 41 wherein the flexible skin layer is formed of a film sheet.

52. An inkjet printing mechanism according to claim 51 wherein the film sheet is of an elastomeric material.

53. An inkjet printing mechanism according to claim 51 wherein the film sheet is of a material selected from the group consisting of polyethylene, Saran®, polyvinylidene chloride, polypropylene, and Teflon®.

* * * * *